US009153189B2

(12) United States Patent
Moon

(10) Patent No.: US 9,153,189 B2
(45) Date of Patent: Oct. 6, 2015

(54) LIQUID CRYSTAL DISPLAY APPARATUS

(75) Inventor: Seung-Hwan Moon, Yongin-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 1018 days.

(21) Appl. No.: 11/874,524

(22) Filed: Oct. 18, 2007

(65) Prior Publication Data

US 2008/0036717 A1 Feb. 14, 2008

Related U.S. Application Data

(62) Division of application No. 10/454,157, filed on Jun. 4, 2003, now Pat. No. 7,327,338.

(30) Foreign Application Priority Data

Aug. 30, 2002 (KR) ..... 2002-52020

(51) Int. Cl.
*G09G 3/36* (2006.01)

(52) U.S. Cl.
CPC ..... *G09G 3/3677* (2013.01); *G09G 2330/08* (2013.01)

(58) Field of Classification Search
USPC ..... 345/87, 94–96, 98–100
See application file for complete search history.

(56) References Cited

U.S. PATENT DOCUMENTS

| | | | | |
|---|---|---|---|---|
| 5,900,854 | A | 5/1999 | Itoh et al. | |
| 5,949,398 | A * | 9/1999 | Kim | 345/100 |
| 6,052,426 | A | 4/2000 | Maurice | |
| 6,292,163 | B1 * | 9/2001 | Nam et al. | 345/100 |
| 6,373,459 | B1 * | 4/2002 | Jeong | 345/100 |
| 6,414,670 | B1 | 7/2002 | Kim | |
| 2001/0003418 | A1 * | 6/2001 | Fujita et al. | 324/76.54 |
| 2001/0033266 | A1 * | 10/2001 | Lee | 345/94 |
| 2001/0040518 | A1 * | 11/2001 | Coene | 341/59 |
| 2002/0011982 | A1 * | 1/2002 | Takeuchi et al. | 345/92 |
| 2002/0118157 | A1 | 8/2002 | Lee et al. | |
| 2002/0175376 | A1 * | 11/2002 | Ohtani et al. | 257/350 |

FOREIGN PATENT DOCUMENTS

| | | | |
|---|---|---|---|
| EP | 1231594 | A1 * | 8/2002 |
| JP | 08-292741 | | 11/1996 |
| JP | 10-039340 | | 2/1998 |
| JP | 2001-222260 | | 8/2001 |
| JP | 2002-023712 | | 1/2002 |
| JP | 2002-108310 | | 4/2002 |
| TW | 374149 | | 11/1999 |
| TW | 435043 | | 5/2001 |

OTHER PUBLICATIONS

English Abstract for Publication No. 2002-108310.

* cited by examiner

*Primary Examiner* — Seokyun Moon
*Assistant Examiner* — Josemarie G Acha, III
(74) *Attorney, Agent, or Firm* — F. Chau & Associates, LLC

(57) ABSTRACT

Disclosed is an LCD apparatus having improved display characteristics. A clock generator applies first and second clock signals to a gate driver so as to control a pulse width of a gate driving signal. A discharging transistor connected to first ends of gate lines discharges a present stage before operating a next stage. The gate lines include a first gate driver and a second gate driver for operating the gate lines while the first gate driver is operated in an abnormal state. Accordingly, the LCD apparatus may be operated in high-speed and prevent the gate driving signal from being delayed.

9 Claims, 20 Drawing Sheets

LIQUID CRYSTAL DISPLAY APPARATUS

This is a divisional application of U.S. application Ser. No. 10/454,157, filed on Jun. 4, 2003 now U.S. Pat. No. 7,327, 338, and which claims foreign priority under 35 U.S.C. §119 to Korean Patent Application No. 2002-52020 filed Aug. 30, 2002, which are hereby incorporated by reference for all purposes as if fully set forth herein.

BACKGROUND OF THE INVENTION

1. Field of the Invention

The present invention relates generally to an LCD (Liquid Crystal Display) apparatus, and more particularly, to an LCD apparatus having improved display characteristics.

2. Description of the Related Art

A liquid crystal display (LCD) apparatus generally includes two substrates, each having an electrode formed on an inner surface thereof, and a liquid crystal layer interposed between the two substrates. In the LCD apparatus, a voltage is applied to the electrodes to re-align liquid crystal molecules and control an amount of light transmitted through the liquid crystal layer, thereby obtaining desired images.

TFT-LCDs are now the most common type of LCDs. Electrodes are formed on each of the two substrates and thin film transistors (TFTs) are used for switching power supplied to each electrode. The TFT is typically formed on one side of the two substrates. Generally, an LCD apparatus in which TFTs are respectively formed in unit pixel regions is classified as an amorphous silicon type TFT-LCD (amorphous-Si TFT-LCD) and a polycrystalline silicon type TFT-LCD (poly-Si TFT-LCD).

The poly-Si TFT-LCD apparatus has the advantages of lower power consumption and lower price compared with the amorphous-Si TFT-LCD apparatus but has a drawback in that its manufacturing process is complicated. Thus, the poly-Si TFT-LCD apparatus is mainly used in small sized displays, such as mobile phones, and the amorphous-Si TFT-LCD apparatus, due to its ease of application to a large screen and high production yield, is applied to large sized displays such as notebook personal computers (PC), LCD monitors, high definition (HD) televisions, etc.

Recently, much research and development efforts have focused on methods for decreasing the number of steps of the assembly process for an amorphous-Si TFT-LCD apparatus, by simultaneously forming a data driving circuit and a gate driving circuit along with a pixel array on a glass substrate, similar to the assembly process of the poly-Si TFT-LCD apparatus. Other areas of research focus include methods for increasing the operational speed and resolution of LCDs, such as by operating more signal lines of the TFT-LCD apparatus within a certain time period.

SUMMARY OF THE INVENTION

An embodiment of the present invention provides an LCD capable of being operated in high-speed.

Another embodiment of the present invention provides an LCD capable of preventing a gate driving signal from being delayed.

A further embodiment of the present invention provides an LCD capable of preventing a gate driving signal from being delayed with a redundancy function.

In one aspect of the invention, an LCD apparatus comprises a timing controller for outputting an image signal, a first timing signal, a second timing signal and a clock generating control signal in response to an external signal; a clock generator for generating first and second clock signals having phases opposite to each other and controlling the first and second clock signals during a first period so as to determine a voltage level of a gate driving signal and a second period so as to charge or discharge the first and second clock signals; a gate driver for sequentially outputting the gate driving signal in response to the first timing signal, the first clock signal and the second clock signal; a data driver for outputting the image signal in response to the second timing signal; and an LCD panel having a plurality of data lines for receiving the image signal, a plurality of gate lines for receiving the gate driving signal, and a switching device connected to the data and gate lines, for outputting the image signal in response to the gate driving signal.

In another aspect, an LCD apparatus comprises an LCD panel having a plurality of gate lines extended in a first direction, a plurality of data lines extended in a second direction perpendicular to the first direction, a switching device having a first electrode connected to the gate lines and a second electrode connected to the data lines and a pixel electrode connected to a third electrode of the switching device; a gate driver connected to the gate lines for sequentially applying a gate driving signal to the gate lines; a data driver connected to the data lines for applying a data driving signal to the data lines; and a discharger for discharging a second gate driving signal applied to a present gate line in response to a first gate driving signal applied to a next gate line.

In a further aspect, an LCD apparatus comprises an LCD panel having a plurality of gate lines extended in a first direction, a plurality of data lines extended in a second direction perpendicular to the first direction, a switching device having a first electrode connected to the gate lines and a second electrode connected to the data lines and a pixel electrode connected to a third electrode of the switching device; a first gate driver connected to first ends of the gate lines for sequentially applying a gate driving signal to the gate lines; a second gate driver connected to second ends of the gate lines for sequentially applying the gate driving signal to the gate lines when the first gate driver is misoperated; a data driver connected to the data lines for applying a data driving signal to the data lines; and a first discharger for discharging a second gate driving signal applied to a present gate line in response to a first gate driving signal applied to a next gate line when the first gate driver is operated; and a second discharger for discharging the second gate driving signal in response to the second gate driving signal when the second gate driver is operated.

According to an embodiment of the LCD apparatus, the LCD apparatus may be operated in high-speed due to the first and second clock signals respectively having a first period for determining the voltage level of the gate driving signal and a second period for charging or discharging the first and second clock signals.

Also, the discharging transistor connected to first ends of gate lines discharges a present stage before operating a next stage, thereby preventing the gate driving signal from being delayed.

Further, the gate lines include the first gate driver and the second gate driver for operating the gate lines while the first gate driver is operated in an abnormal state. Thus, although the first gate driver is operated abnormally, the LCD apparatus may be operated in normal state due to the second gate driver.

BRIEF DESCRIPTION OF THE DRAWINGS

The above and other advantages of the present invention will become readily apparent by reference to the following detailed description when considered in conjunction with the accompanying drawings wherein.

DETAILED DESCRIPTION OF PREFERRED EMBODIMENTS

Figure 1:
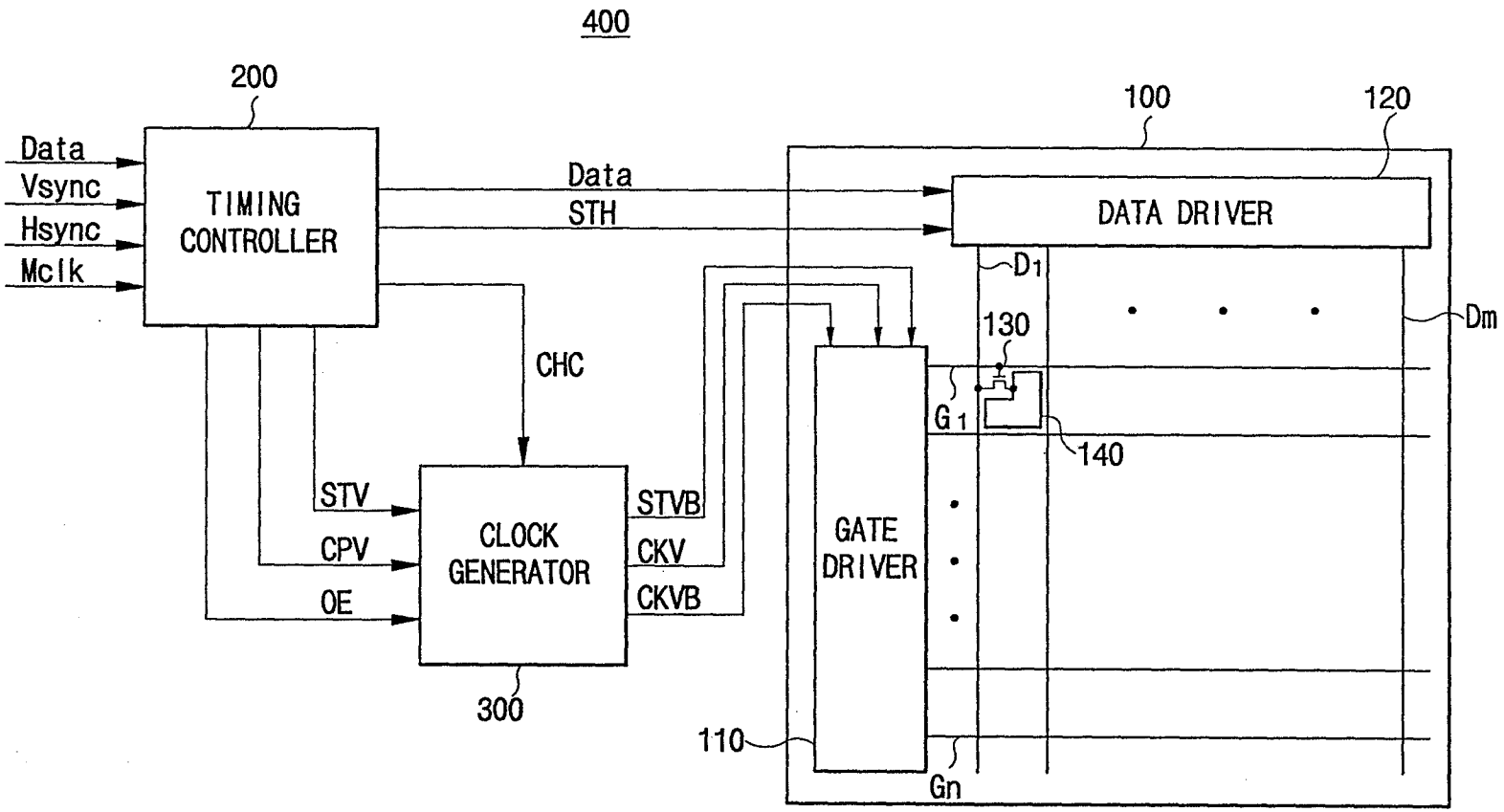
FIG. 1 is a block diagram showing an LCD apparatus according to an embodiment of the present invention.

FIG. 1 is a block diagram showing an LCD apparatus according to an embodiment of the present invention.

Referring to FIG. 1, an LCD apparatus 400 includes an LCD panel 100 on which gate and data drivers 110 and 120 are disposed, a timing controller 200 for controlling the LCD panel 100 in response to an external signal and a clock generator 300 for generating first and second clock signals CKV and CKVB applied to the gate driver 110.

The timing controller 200 generates timing signals to control the gate and data drivers 110 and 120. The timing controller 200 applies a horizontal start signal STH to the data driver 120 in response to an H-sync (Horizontal synchronization) signal provided from an external device. The data driver 120 converts image data provided from the timing controller 200 into analog image data and supplies the analog image data to data lines in response to the horizontal start signal STH from the timing controller 200. The timing controller 200 applies a first vertical start signal STV to the clock generator 300 in response to a V-sync (Vertical synchronization) signal provided from the external device.

The timing controller 200 applies a gate clock signal CPV for determining a period of a gate driving signal, an enable signal OE for enabling the gate driving signal and a charging/discharging control signal CHC for controlling charging or discharging of the first and second clock signals CKV and CKVB to the clock generator 300.

The LCD panel 100 includes a plurality of gate lines G1~Gn extended in a first direction, a plurality of data lines D1~Dm extended in a second direction perpendicular to the first direction, a TFT 130 connected to the gate lines G1~Gn and data lines D1~Dm and a pixel electrode 140 connected to the TFT 130.

The LCD panel 100 includes the gate driver 110 for sequentially applying the gate driving signal to the gate lines G1~Gn and the data driver 120 for applying the data signal to the data lines D1~Dm. The LCD panel 100 further includes a TFT substrate, a color filter substrate and a liquid crystal interposed between the TFT substrate and the color filter substrate. The gate lines G1~Gn, the data lines D1~Dm, the TFT 130 and the pixel electrode 140 are disposed on the TFT substrate.

The data driver 120 generates a data signal applied to respective pixels of the LCD panel 100 in response to the horizontal start signal STH. The data signal generated from the data driver 120 is a charging voltage for charging the respective pixels.

The gate driver 110 includes a shifter register in which plural stages are connected one after another to each other and the gate lines G1~Gn are connected to the plural stages, respectively. Therefore, the plural stages sequentially output the gate driving signal to the gate lines G1~Gn. That is, the gate driver 110 sequentially applies the gate driving signal having a high level period to the gate lines G1~Gn to control the data signal applied to respective pixels in response to a second vertical start signal STVB having a phase opposite to that of the first vertical start signal STV. The gate driving signal has a voltage level sufficient to drive the TFT 130 connected to the gate lines G1~Gn. When the TFT 130 is operated in response to the gate driving signal, the data signal is applied to the pixel electrode 140 through the TFT 130 to charge the liquid crystal layer.

The clock generator 300 outputs the first clock signal CKV and the second clock signal CKVB having a phase opposite to that of the first clock signal CKV in response to the gate clock signal CPV and the enable signal OE. The first clock signal CKV is applied to odd-numbered stages of the gate driver 110 and the second clock signal CKVB is applied to even-numbered stages of the gate driver 110.

The clock generator 300 includes first and second voltage applying circuits (not shown) and a charging/discharging circuit (not shown). The first and second voltage applying circuits generate the first and second clock signals CKV and CKVB having a predetermined voltage so as to determine a level of the gate driving signal in response to the gate clock signal CPV, the enable signal OE and the first vertical start signal STV. The charging/discharging circuit controls the first and second clock signals CKV and CKVB to be charged or discharged in response to the gate clock signal CPV and the charging/discharging signal CHC. The clock generator 300 outputs the second vertical start signal STVB to the gate driver 110 to sequentially apply the first vertical start signal STV from the gate driver 110 to the gate lines G1~Gn.

Accordingly, the first and second clock signals CKV and CKVB have a predetermined voltage during a first period and is charged or discharged during a second period. By controlling the first and second clock signals CKV and CKVB, a pulse width of the gate driving signal is reduced, so that the gate driver 110 may be operated in high-speed.

Also, the clock generator 300 may use the gate clock signal CPV and the enable signal OE without additional control signals applied to the clock generator 300 to generate the first and second clock signals CKV and CKVB.

Figure 2:
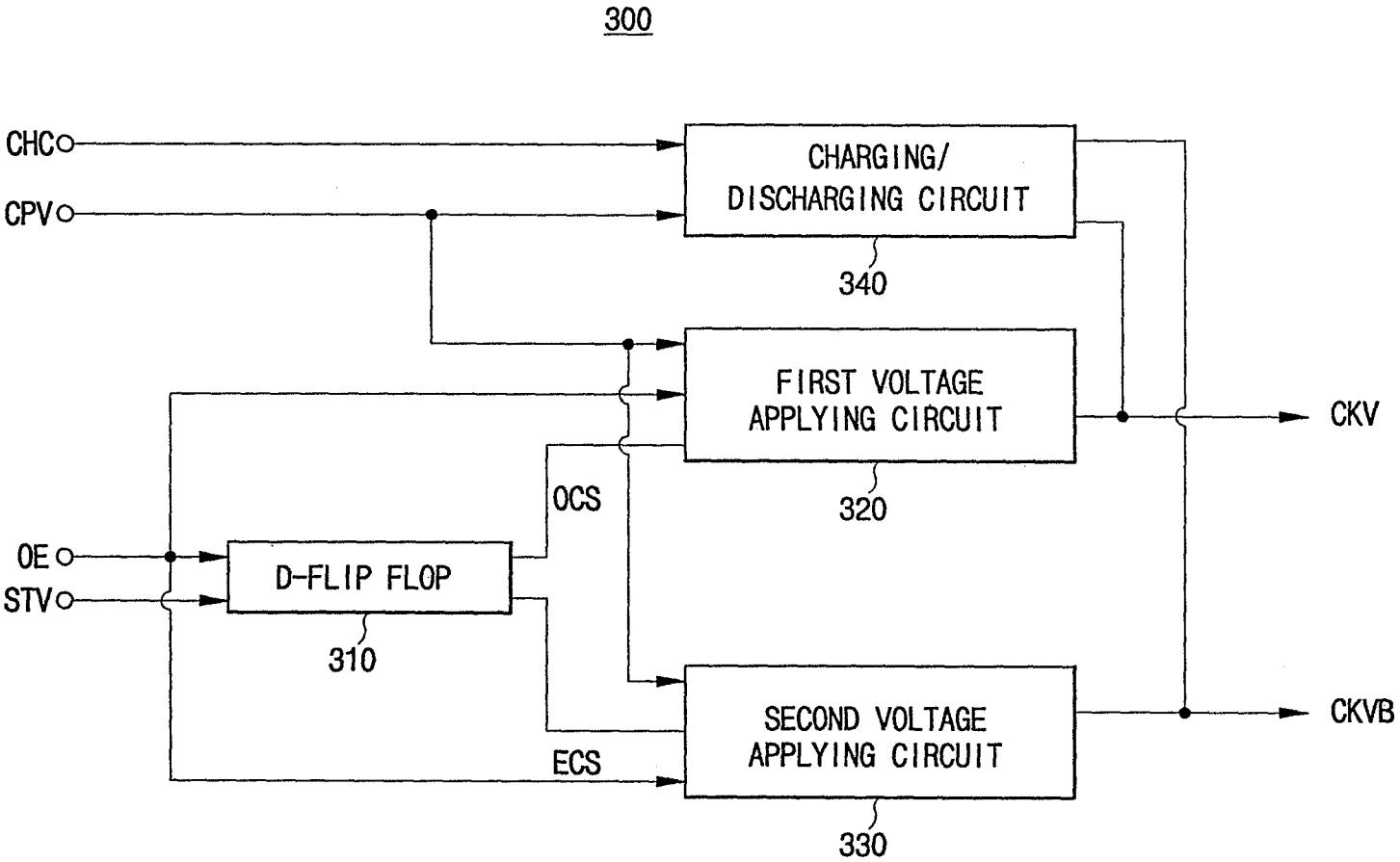
FIG. 2 is a block diagram showing the clock generator shown in FIG. 1.
Figure 3:
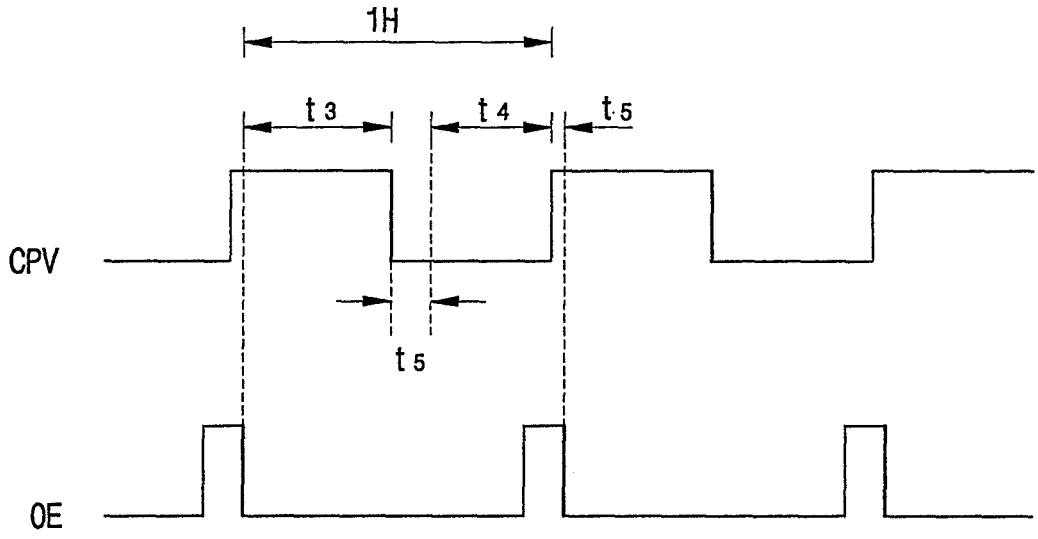
FIG. 3 is a timing diagram of respective elements shown in FIG. 2.

FIG. 2 is a block diagram showing the clock generator shown in FIG. 1 and FIG. 3 is a timing diagram of respective elements shown in FIG. 2.

Referring to FIG. 2, the clock generator 300 includes a D-flip flop 310 for outputting a first clock enable signal OCS (Odd Clock Pulse) and a second clock enable signal ECS (Even Clock Pulse), a first voltage applying circuit 320 for outputting the first clock signal CKV in response to the first clock enable signal OCS, a second voltage applying circuit 330 for outputting the second clock signal CKVB in response to the second clock enable signal ECS and a charging/discharging circuit 340 for charging or discharging the first and second clock signals CKV and CKVB.

The D-flip flop 310 receives the vertical start signal STV and synchronizes with the enable signal OE so as to output the first and second clock enable signals OCS and ECS through first and second terminals QB and Q, respectively. The enable signal OE delays the output from the gate driver 110 by a delay time of the gate driving signal. That is, the enable signal OE has a high level while the gate driving signal is delayed during first period 1H.

The first voltage applying circuit 320 outputs the first clock signal CKV having the predetermined voltage during the first period in response to the gate clock signal CPV, the enable signal OE and the first clock enable signal OCS. The second voltage applying circuit 330 outputs the second clock signal CKVB having the predetermined voltage during the first period in response to the gate clock signal CPV, the enable signal OE and the second clock enable signal ECS. The charging/discharging circuit 340 receives the gate clock signal CPV and charges or discharges the first and second clock signals CKV and CKVB when the first and second voltage applying circuits 320 and 330 are turned off.

As shown in FIG. 3, the gate clock signal CPV has a first period 1H and the enable signal OE is generated in the first period 1H and has a high level of a predetermined duty while the gate driving signal is delayed.

During a third period t3 of which the gate clock signal CPV has a high level and the enable signal OE has a low level, the first and second voltage applying circuits 320 and 330 are operated. During a fourth period t4 of which the gate clock signal CPV has the low level and the enable signal OE has the low level or the high level, the charging/discharging circuit 340 is operated. During a fifth period t5 between the third and fourth periods t3 and t4, the first voltage applying circuit 320, the second voltage applying circuit 330 and the charging/discharging circuit 340 are in a disable state. In the fifth period t5, the gate clock signal CPV and the enable signal OE have the low level or high level, respectively.

Hereinafter, the clock generator 300 will be described in detail.

Figure 4:
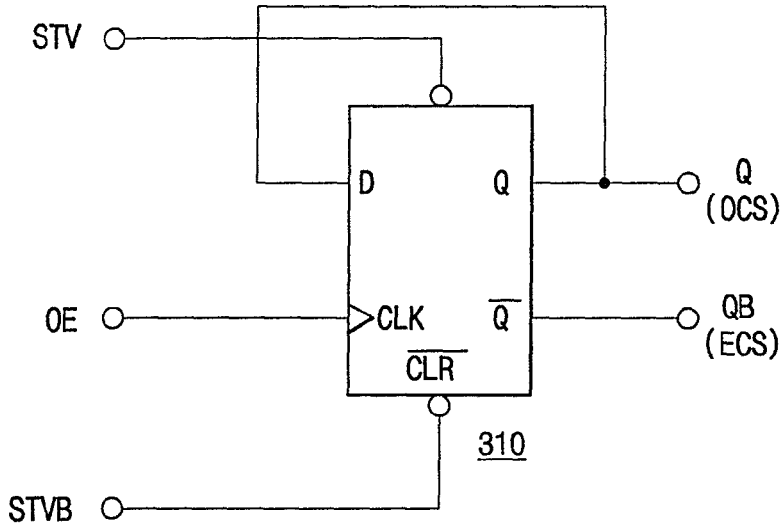
FIG. 4 is a circuit diagram showing the D-flip flop shown in FIG. 2.
Figure 5:
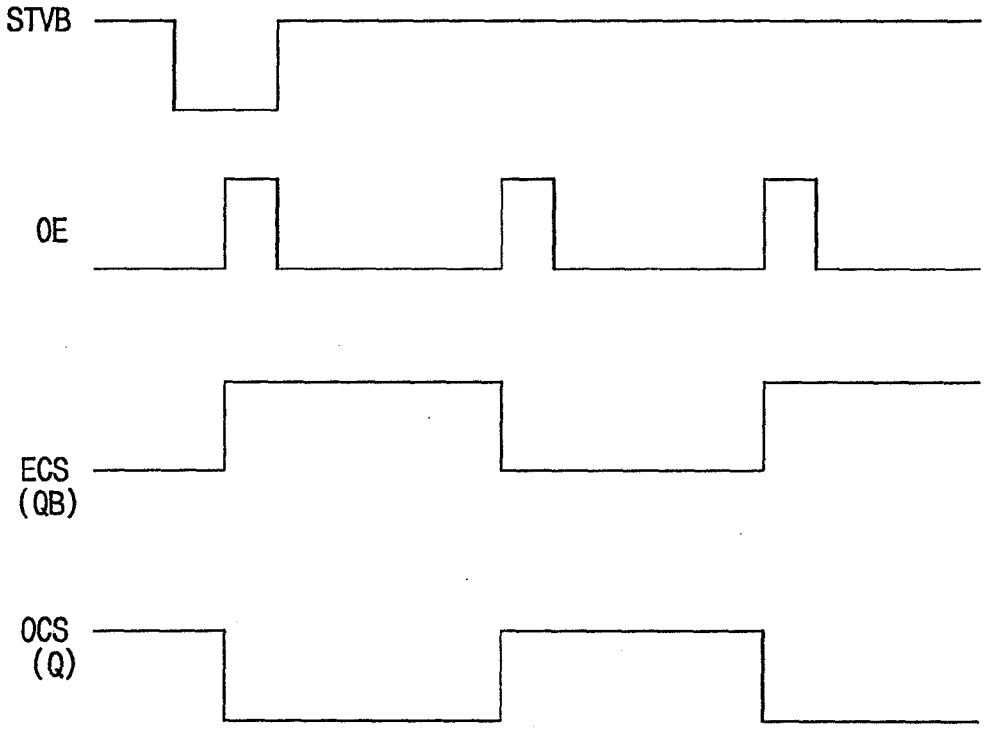
FIG. 5 is a timing diagram of the D-flip flop shown in FIG. 4.

FIG. 4 is a circuit diagram showing the D-flip flop shown in FIG. 2 and FIG. 5 is a timing diagram of the D-flip flop shown in FIG. 4.

Referring to FIGS. 4 and 5, when the D-flip flop 310 is cleared in response to the second vertical start signal STVB having the phase opposite to that of the first vertical start signal STV, the second clock enable signal ECS outputted from the first terminal QB of the D-flip flop 310 has a high level. That is, the D-flip flop 310 receives the first vertical start signal STV and outputs the first and second clock enable signals OCS and ECS having two high levels (2H) as one period in response to the enable signal OE inputted through a clock terminal CLK thereof. The first clock enable signal OCS enables the first voltage applying circuit 320 that outputs the first clock signal CKV applied to the odd-numbered stages of the gate driver 110 and the second clock enable signal ECS enables the second voltage applying circuit 330 that outputs the second clock signal CKVB applied to the even-numbered stages of the gate driver 110.

Figure 6:
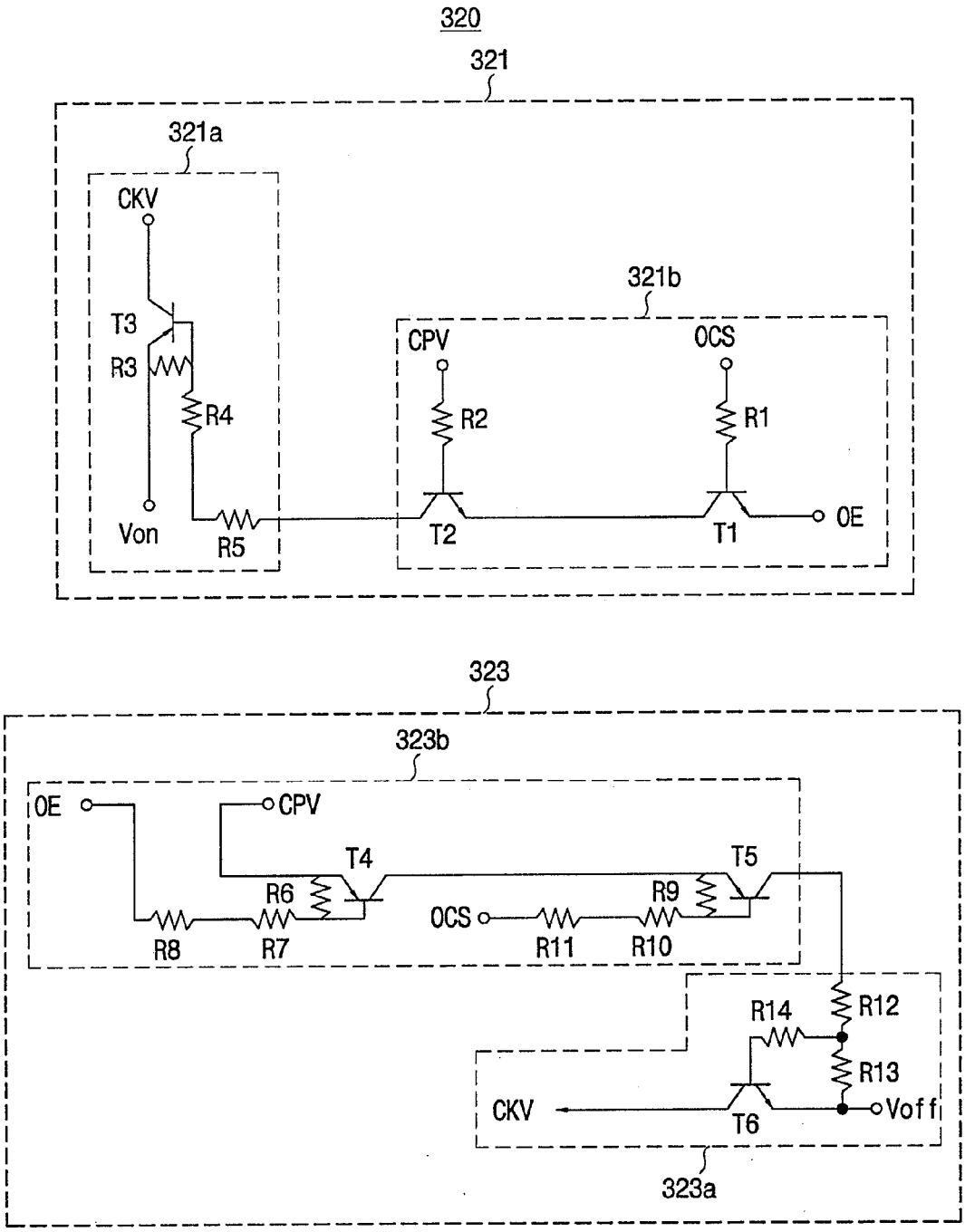
FIG. 6 is a circuit diagram showing the first voltage applying circuit shown in FIG. 2.
Figure 7:
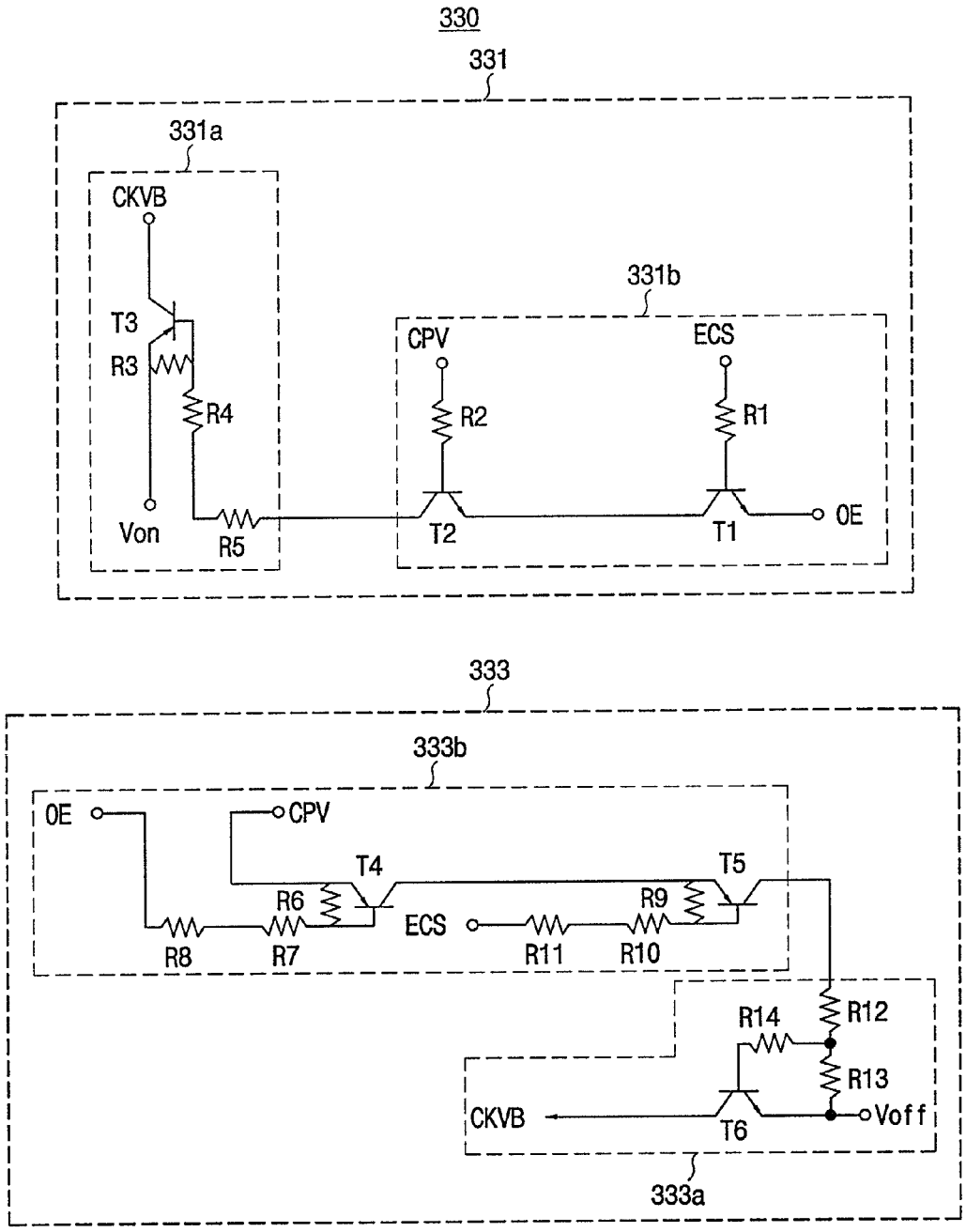
FIG. 7 is a circuit diagram showing the second voltage applying circuit shown in FIG. 2.

FIG. 6 is a circuit diagram showing the first voltage applying circuit shown in FIG. 2 and FIG. 7 is a circuit diagram showing the second voltage applying circuit shown in FIG. 2.

Referring to FIG. 6, the first voltage applying circuit 320 includes a first power voltage supplier 321 for supplying a first power voltage Von to the first clock signal CKV in response to the first clock enable signal OCS having a high level and a second power voltage supplier 323 for supplying a second power voltage Voff to the first clock signal CKV in response to the first clock enable signal OCS having a low level.

The first power voltage supplier 321 includes an on-voltage generator 321*a* and a first controller 321*b* for controlling operation of the on-voltage generator 321*a*.

The first controller 321*b* includes a first transistor T1, a second transistor T2, a first resistor R1 and a second resistor R2.

The first transistor T1 includes an emitter connected to a terminal for the enable signal OE and a collector connected to an emitter of the second transistor T2. The first resistor R1 is connected between a base of the first transistor T1 and a terminal for the first clock enable signal OCS. The second transistor T2 has a collector connected to the on-voltage generator 321*a*. The second resistor R2 is connected between a base of the second transistor T2 and a terminal for the gate clock signal CPV.

Accordingly, the first transistor T1 is turned on in response to a voltage difference between the first clock enable signal OCS and the enable signal OE and the second transistor T2 is turned on in response to a voltage difference between the enable signal OE provided from the first transistor T1 and the gate clock signal CPV, thereby controlling operation of the on-voltage generator 321*a*.

The on-voltage generator 321*a* includes a third transistor T3, a third resistor R3, a fourth resistor R4 and a fifth resistor R5.

The third transistor T3 includes an emitter connected to a terminal for the first power voltage Von and a collector connected to a terminal for the first clock signal CKV. The third resistor R3 is connected between the emitter and a base of the third transistor T3. The fourth and fifth resistors R4 and R5 are connected between the base of the third transistor T3 and the collector of the second transistor T2 in series. Thus, the third transistor T3 outputs the first clock signal CKV through the terminal.

The second power voltage supplier 323 includes an off-voltage generator 323*a* and a second controller 323*b* for controlling the off-voltage generator 323*a*.

The second controller 323*b* includes a fourth transistor T4, a fifth transistor T5 and sixth to eleventh resistors R6~R11.

The fourth transistor T4 includes an emitter connected to the terminal for the gate clock signal CPV and a collector connected to the fifth transistor T5. The sixth resistor R6 is connected between the emitter and base of the fourth transistor T4. The seventh and eighth resistors R7 and R8 are connected between the base of the fourth transistor T4 and the terminal for the enable signal OE in series. The fifth transistor T5 includes a collector connected to the off-voltage generator 323*a*. The ninth resistor R9 is connected between the emitter and base of the fifth transistor T5. The tenth and eleventh resistors R10 and R11 are connected between the base of the fifth transistor T5 and the terminal for first clock enable signal OCS in series.

The fourth transistor T4 outputs the gate clock signal CPV in response to a voltage difference between the gate clock signal CPV and the enable signal OE and the fifth transistor T5 outputs the gate clock signal CPV in response to a voltage difference between the gate clock signal CPV outputted from the fourth transistor T4 and the first clock enable signal OCS. The gate clock signal CPV outputted from the fifth transistor T5 is provided to the off-voltage generator 323*a*.

The off-voltage generator 323*a* includes a sixth transistor T6, a twelfth resistor R12, a thirteenth resistor R13 and a fourteenth resistor R14.

The sixth transistor T6 includes an emitter connected to a terminal for the second power voltage Voff and a collector connected to a terminal for the first clock signal CKV. The twelfth resistor R12 is connected between the collector of the fifth transistor T5 and first terminals of the thirteenth and fourteenth resistors R13 and R14 in parallel, a second terminal of the thirteenth resistor R13 is connected to the emitter of the sixth transistor T6 and a second terminal of the fourteenth resistor R14 is connected to a base of the sixth transistor T6. Thus, when the sixth transistor T6 is turned on in response to the gate clock signal CPV outputted from the second controller 323*b*, the second power voltage Voff is outputted through the terminal for the first clock signal CKV.

In FIG. 6, the first to sixth transistors T1, T2, T3, T4, T5 and T6 are bipolar junction transistors.

Referring to FIG. 7, the second voltage applying circuit 330 includes a first power voltage supplier 331 for supplying a first power voltage Von to the second clock signal CKVB in response to the second clock enable signal ECS having a high level and a second power voltage supplier 333 for supplying a second power voltage Voff to the second clock signal CKVB in response to the second clock enable signal ECS having a low level.

The first power voltage supplier 331 includes an on-voltage generator 331*a* and a first controller 331*b* for controlling operation of the on-voltage generator 331*a*.

The first controller 331*b* includes a first transistor T1, a second transistor T2, a first resistor R1 and a second resistor R2.

The first transistor T1 includes an emitter connected to a terminal for the enable signal OE and a collector connected to an emitter of the second transistor T2. The first resistor R1 is connected between a base of the first transistor T1 and a terminal for the second clock enable signal ECS. The second transistor T2 includes a collector connected to the on-voltage generator 331*a*. The second resistor R2 is connected between a base of the second transistor T2 and a terminal for the gate clock signal CPV.

Accordingly, the first transistor T1 is turned on in response to a voltage difference between the second clock enable signal ECS and the enable signal OE and the second transistor T2 is turned on in response to a voltage difference between the enable signal OE provided from the first transistor T1 and the gate clock signal CPV, thereby controlling operation of the on-voltage generator 331*a*.

The on-voltage generator 331*a* includes a third transistor T3, a third resistor R3, a fourth resistor R4 and a fifth resistor R5.

The third transistor T3 includes an emitter connected to a terminal for the first power voltage Von and a collector connected to a terminal for the second clock signal CKVB. The third resistor R3 is connected between the emitter and a base of the third transistor T3. The fourth and fifth resistors R4 and R5 are connected between the base of the third transistor T3 and the collector of the second transistor T2 in series. Thus, the third transistor T3 outputs the second clock signal CKVB through the terminal.

The second power voltage supplier 333 includes an off-voltage generator 333*a* and a second controller 333*b* for controlling the off-voltage generator 323*a*.

The second controller 333*b* includes a fourth transistor T4, a fifth transistor T5 and sixth to eleventh resistors R6~11.

The fourth transistor T4 includes an emitter connected to the terminal for the gate clock signal CPV and a collector connected to and emitter of the fifth transistor T5. The sixth resistor R6 is connected between the emitter and base of the fourth transistor T4. The seventh and eighth resistors R7 and R8 are connected between the base of the fourth transistor T4 and the terminal for the enable signal OE in series. The fifth transistor T5 includes a collector connected to the off-voltage generator 333*a*. The ninth resistor R9 is connected between the emitter and base of the fifth transistor T5. The tenth and eleventh resistors R10 and R11 are connected between the base of the fifth transistor T5 and the terminal for second clock enable signal ECS in series.

The fourth transistor T4 outputs the gate clock signal CPV in response to a voltage difference between the gate clock signal CPV and the enable signal OE and the fifth transistor T5 outputs the gate clock signal CPV in response to a voltage difference between the gate clock signal CPV outputted from the fourth transistor T4 and the second clock enable signal ECS. The gate clock signal CPV outputted from the fifth transistor T5 is provided to the off-voltage generator 333*a*.

The off-voltage generator 333*a* includes a sixth transistor T6, a twelfth resistor R12, a thirteenth resistor R13 and a fourteenth resistor R14.

The sixth transistor T6 includes an emitter connected to a terminal for the second power voltage Voff and a collector connected to a terminal for the second clock signal CKVB. The twelfth resistor R12 is connected between the collector of the fifth transistor T5 and first terminals of the thirteenth and fourteenth resistors R13 and R14 in parallel, a second terminal of the thirteenth resistor R13 is connected to the emitter of the sixth transistor T6 and a second terminal of the fourteenth resistor R14 is connected to a base of the sixth transistor T6. Thus, when the sixth transistor T6 is turned on in response to the gate clock signal CPV outputted from the second controller 333*b*, the second power voltage Voff is outputted through the terminal for the second clock signal CKVB.

In FIG. 7, the first to sixth transistors T1, T2, T3, T4, T5 and T6 are bipolar junction transistors.

Figure 8:
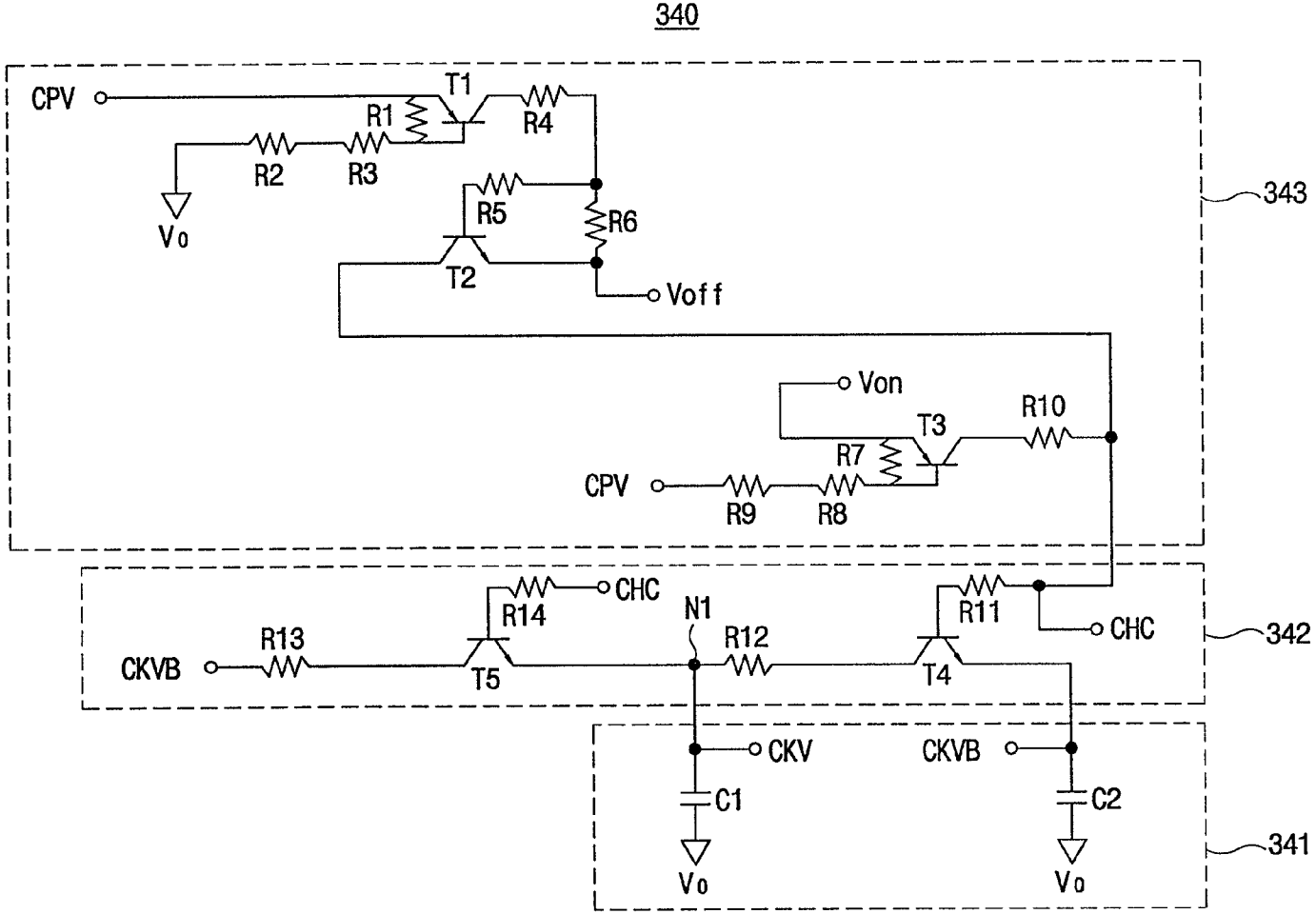
FIG. 8 is a circuit diagram showing the charging/discharging circuit shown in FIG. 2.

FIG. 8 is a circuit diagram showing the charging/discharging circuit shown in FIG. 2.

Referring to FIG. 8, the charging/discharging circuit 340 includes a charger 341 for charging or discharging the first and second clock signals CKV and CKVB, a charging driver 342 for driving the charger 341 and a charging controller 343 for controlling the charging driver 342.

The charging controller 343 includes first to third transistors T1~T3 and first to tenth resistors R1~R10.

The first transistor T1 includes an emitter connected to a terminal for the gate clock signal CPV and a collector connected to a first terminal of the fourth resistor R4. The first resistor R1 is connected between the emitter and base of the first transistor T1. The second and third resistors R2 and R3 are connected between the base of the first transistor T1 and a ground terminal $V_0$ in series. The fourth resistor R4 is connected to the fifth and sixth resistors R5 and R6 in parallel. The fifth resistor R5 is connected to a base of the second transistor T2 and the sixth resistor R6 is connected to the emitter of the second transistor T2.

The third transistor T3 includes an emitter connected to a terminal for the first power voltage Von and a collector connected to a collector of the second transistor T2 through the tenth resistor R10. The seventh resistor R7 is connected between the emitter and base of the third transistor T3. The eighth and ninth resistors R8 and R9 are connected between the base of the third transistor T3 and the terminal for the gate clock signal CPV in series.

The charging driver 342 includes fourth and fifth transistors T4 and T5 and eleventh to fourteenth resistors R11~R14.

The fourth transistor T4 includes an emitter connected to the terminal for the second clock signal CKVB and a collector connected to the terminal for the first clock signal CKV through the twelfth resistor R12. The eleventh resistor R11 is connected between the base of the fourth transistor T4 and a terminal for the charging/discharging control signal CHC. The fifth transistor T5 includes an emitter connected to the twelfth resistor R12 and a collector connected to the terminal for the second clock signal CKVB through the thirteenth resistor R13. The fourteenth resistor R14 is connected between the base of the fifth transistor T5 and the terminal for the charging/discharging control signal CHC.

The charger 341 includes a first capacitor C1 connected between the terminal for the first clock signal CKV and the ground terminal $V_0$ and a second capacitor C2 connected between the terminal for the second clock signal CKVB and the ground terminal $V_0$.

Accordingly, the charging/discharging circuit 340 is operated when the third and sixth transistors T3 and T6 of the first and second voltage applying circuits 320 and 330 are turned off and the gate clock signal CPV has the low level. That is, when the gate clock signal CPV has the low level, the first and second transistors T1 and T2 of the charging controller 343 are turned off. The first power voltage Von is applied to the charging driver 342 through the third transistor T3 turned on in response to the gate clock signal CPV and the first power voltage Von.

Thus, the fourth transistor T4 of the charging driver 342 is turned on in response to the first power voltage Von and the charging/discharging control signal CHC so as to charge the second capacitor C2. The charging voltage charged to the second capacitor C2 is outputted through the terminal for the second clock signal CKVB. The first capacitor C1 is discharged and the discharging voltage is outputted through the terminal for the first clock signal CKV.

The fifth transistor T5 of the charging driver 342 is turned on in response to the charging/discharging control signal CHC and a potential rises at a first node N1. Thus, the first capacitor C1 is charged and charging voltage charged to the first capacitor C1 is outputted through the terminal for the first clock signal CKV. The second capacitor C2 is discharged and the discharging voltage is outputted through the terminal for the second clock signal CKVB.

When the first and second voltage applying circuits 320 and 330 are turned off and the gate clock signal CPV has the low level, the first and second clock signals CKV and CKVB are charged or discharged.

The tenth resistor R10 connected to the collector of the third transistor T3 delays the first power voltage Von to be applied to the charging driver 342 to drive the charging/discharging circuits 340 while the first and second voltage applying circuits 320 and 330 are not operated. Thus, it is able to prevent the first voltage applying circuit 320, the second voltage applying circuit 330 and the charging/discharging circuit 340 from being operated together during the fifth period t5.

Figure 9:
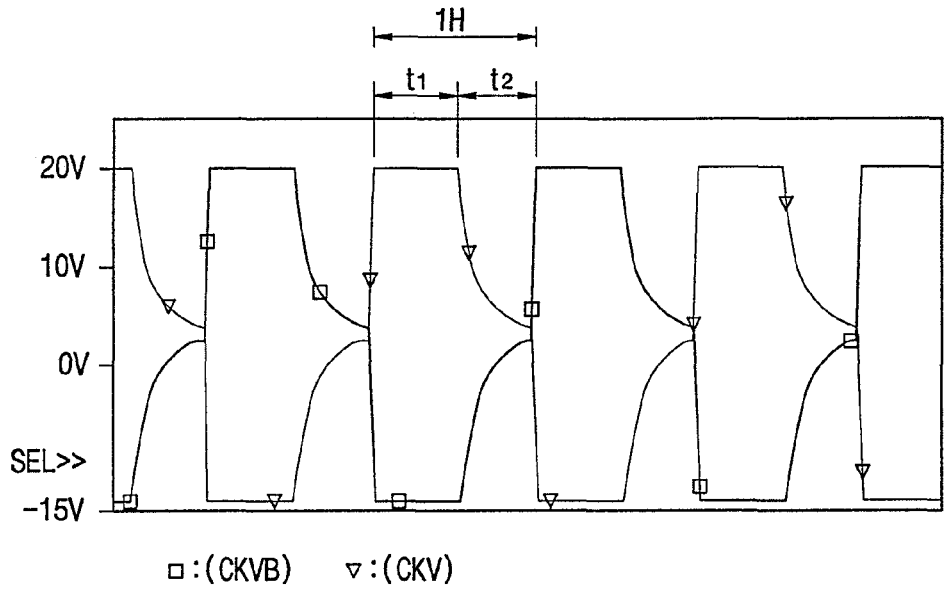
FIG. 9 is a waveform of first and second clock signals from the clock generator shown in FIG. 2.
Figure 10:
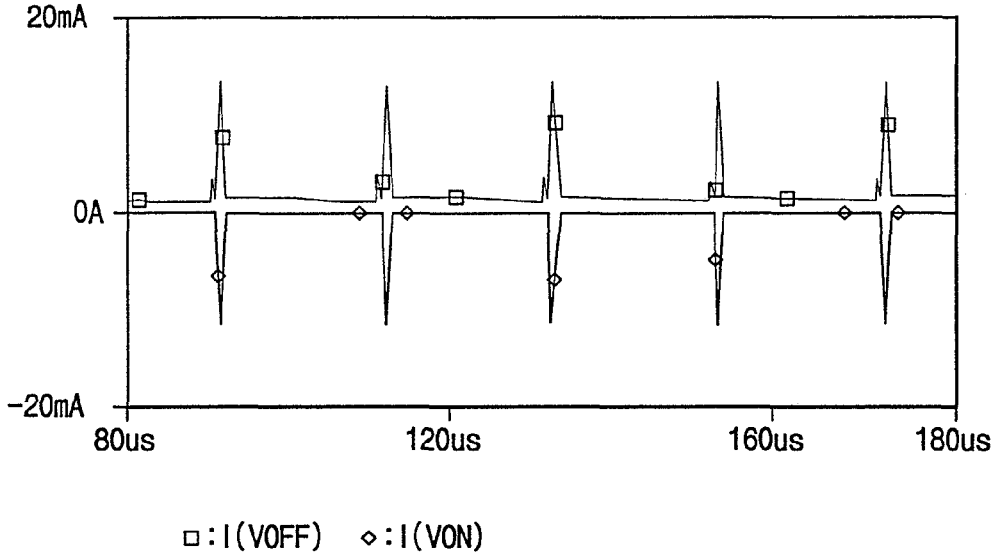
FIG. 10 is a waveform of current needed to output the first and second clock signals from the clock generator shown in FIG. 2.

FIG. 9 is a simulated waveform of the first and second clock CKV and CKVB signals from the clock generator shown in FIG. 2 and FIG. 10 is a simulated waveform of current needed to output the first and second clock signals. In FIGS. 9 and 10, the first and second power voltages Von and Voff are 20 volts and 14 volts, respectively.

Referring to FIGS. 9 and 10, the first clock signal CKV has the first power voltage Von during the first period t1 and has a slope of a first polarity during the second period t2. The second clock signal CKVB has the second power voltage Voff having the phase opposite to that of the first clock signal CKV during the first period t1 and has a slope of a second polarity during the second period t2 opposite to the first polarity.

The first and second clock signals CKV and CKVB respectively have the first and second periods t1 and t2 as 1H and the first and second clock signals CKV and CKVB having the phase opposite to each other are charged or discharged during the second period t2. Thus, the power consumption of the clock generator 300 may be reduced because the voltage transition of the clock generator 300 is reduced about half of that of a conventional waveform.

The power consumption (P) is defined as the following equation:

$$P \propto f \Delta V_2 C \quad (1)$$

When the voltage transition is reduced, the power consumption (P) of the clock generator 300 may be reduced about quarter because the power consumption (P) is in proportion to a square of the voltage transition. That is, the power consumption (P) of the clock generator 300 for generating the first and second clock signals CKV and CKVB may be reduced.

Figure 11:
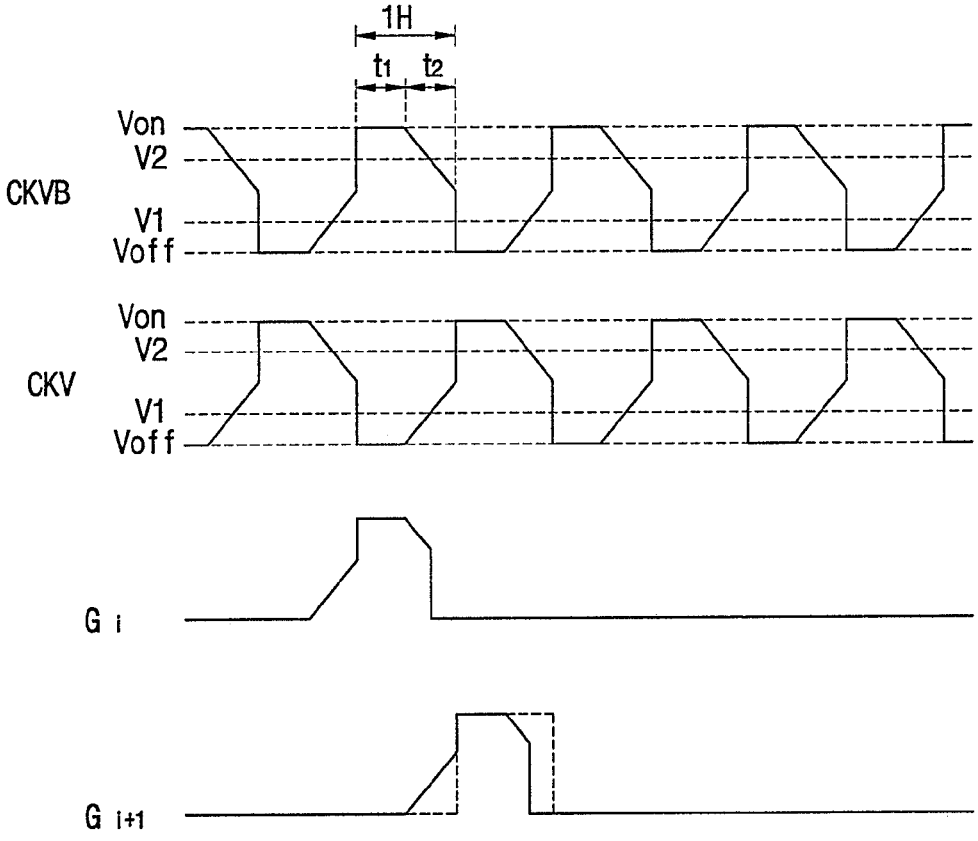
FIG. 11 is an output waveform simulated at a respective stage according to the first and second clock signals.

FIG. 11 is an output waveform simulated at a respective stage according to the first and second clock signals.

Referring to FIG. 11, an $i^{th}$ gate driving signal is outputted from an $i^{th}$ stage at a rising edge of the second clock signal CKVB. When an $i+1^{th}$ gate driving signal outputted from an $i+1^{th}$ stage reaches a voltage V1, the $i^{th}$ gate driving signal is discharged. Thus, the amount of time the $i^{th}$ gate driving signal is maintained at a high level is reduced.

When the gate driver 110 receives the first and second clock signals CKV and CKVB, the pulse width of the gate driving signal may be adjusted and the LCD apparatus 400 may be operated in high-speed.

In FIGS. 1 to 11, the gate clock signal CPV and the enable signal OE are described as a clock generating control signal for controlling the first and second voltage applying circuits 320 and 330 and the charging/discharging circuit 340. However, the clock generating control signal is not limited to that exemplary embodiment.

Figure 12:
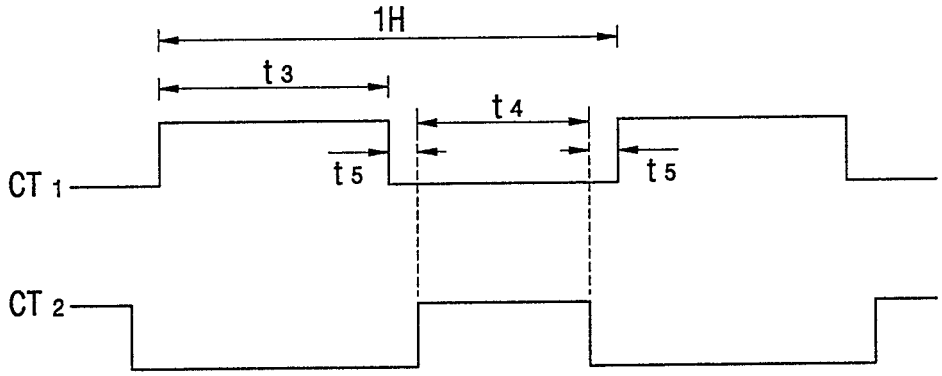
FIGS. 12 and 13 are waveforms of clock generating control signals according to another embodiment of the present invention.
Figure 13:
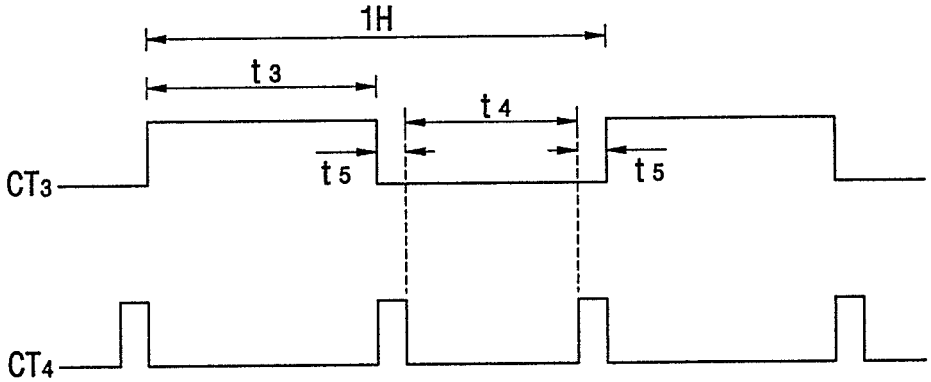

FIGS. 12 and 13 are waveforms of clock generating control signals according to another embodiment of the present invention.

Referring to FIG. 12, the clock generating control signal includes a first control signal CT1 having 1H period and a second control signal CT2 having a phase partially opposite to that of the first control signal CT1 and 1H period. The first and second control signals CT1 and CT2 control operations of the first and second voltage applying circuits 320 and 330 and the charging/discharging circuit 340.

Particularly, during a third period t3 where the first control signal CT1 has a high level and the second control signal CT2 has a low level, the first and second voltage applying circuits 320 and 330 are operated. During a fourth period t4 where the first control signal CT1 has the low level and the second control signal CT2 has the high level, the charging/discharging circuit 340 is operated. Also, during a fifth period t5 where the first and second control signals CT1 and CT2 have the low level, the first and second voltage applying circuits 320 and 330 and the charging/discharging circuit 340 are not operated. The fifth period t5 is provided between the third and fourth periods t3 and t4. Thus, it is able to prevent the first voltage applying circuit 320, the second voltage applying circuit 330 and the charging/discharging circuit 340 from being operated together.

As shown in FIG. 13, the clock generating control signal includes third and fourth control signals CT3 and CT4 having 1H period, respectively. The fourth control signal CT4 is generated as a high level when the third control signal CT3 has a low level. The third and fourth control signals CT3 and CT4 control operations of the first and second voltage applying circuits 320 and 330 and the charging/discharging circuit 340.

Particularly, the first and second voltage applying circuits 320 and 330 are operated during a third period t3 where the third control signal CT3 has the high level and the fourth control signal CT4 has the low level. The charging/discharging circuit 340 is operated during a fourth period t4 where the third control signal CT3 has the low level and the fourth control signal CT4 has the low level. Also, the first and second voltage applying circuits 320 and 330 and the charging/discharging circuit 340 are not operated during a fifth period t5 where the third control signal CT3 has the low level and the fourth control signal CT4 has the high level. The fifth period t5 is provided between the third and fourth periods t3 and t4. Thus, it is able to prevent the first voltage applying circuit 320, the second voltage applying circuit 330 and the charging/discharging circuit 340 from being operated together.

Figure 14:
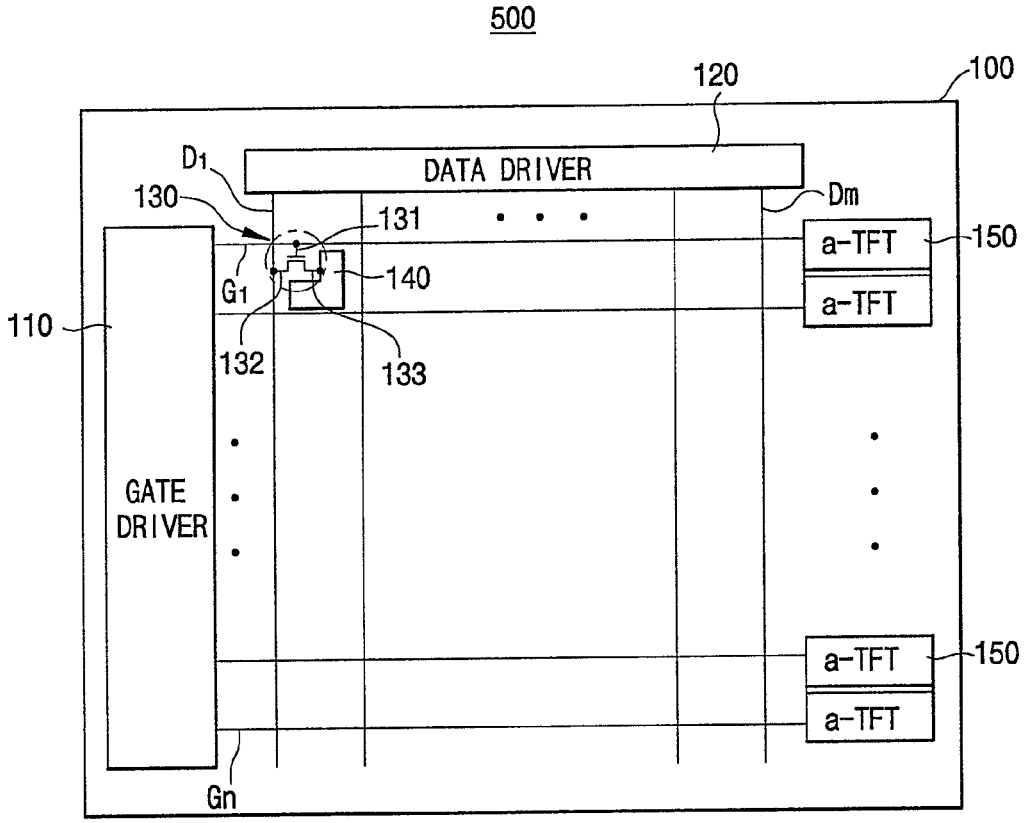
FIG. 14 is a schematic view showing an LCD apparatus according to another embodiment of the present invention.
Figure 15:
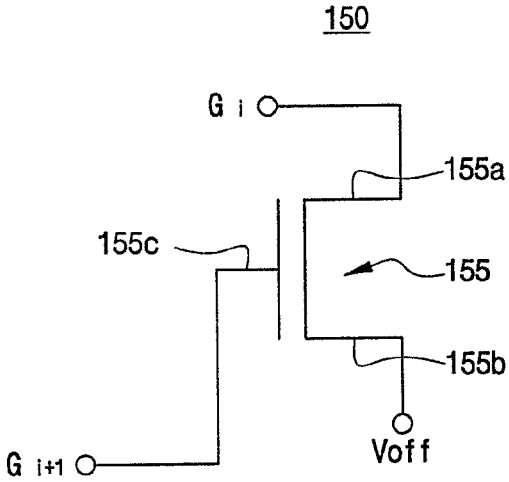
FIG. 15 is a schematic view showing a discharger shown in FIG. 14.
Figure 16:
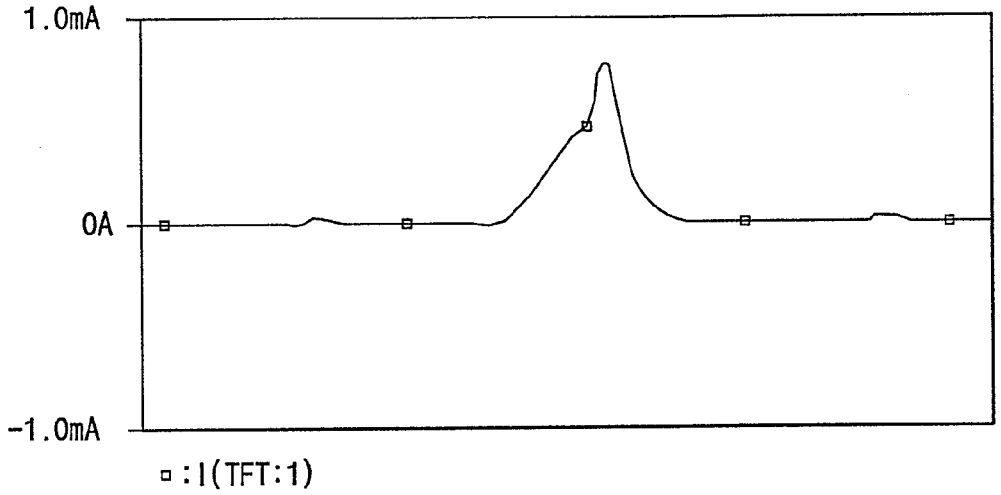
FIG. 16 is a waveform simulated at the discharger shown in FIG. 15.
Figure 17:
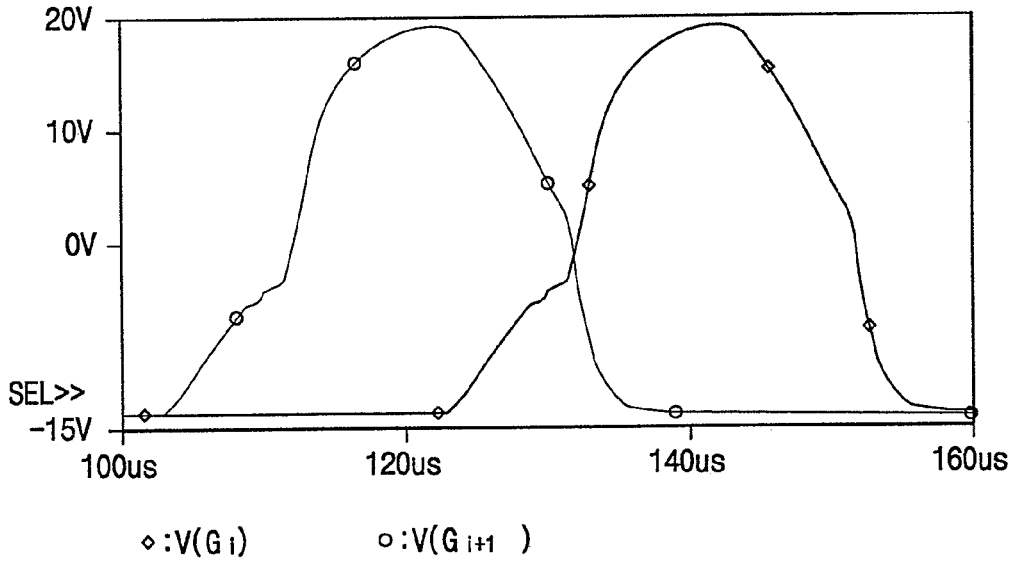
FIG. 17 is a waveform of a gate driving signal of the LCD apparatus shown in FIG. 14.

FIG. 14 is a schematic view showing an LCD apparatus according to another embodiment of the present invention. FIG. 15 is a schematic view showing a discharger shown in FIG. 14. FIG. 16 is a waveform simulated at the discharger shown in FIG. 15. FIG. 17 is a waveform of a gate driving signal of the LCD apparatus shown in FIG. 14.

Referring to FIG. 14, an LCD apparatus 500 includes an LCD panel 100 on which a gate driver 110, a data driver 120 and a discharger 150 are disposed.

The LCD panel 500 includes a plurality of gate lines G1~Gn extended in a first direction, a plurality of data lines D1~Dm extended in a second direction perpendicular to the first direction, a TFT 130 having a first electrode 131 connected to the gate lines G1~Gn and a second electrode 132 connected to the data lines D1~Dm and a pixel electrode 140 connected to a third electrode 133 of the TFT 130. The TFT 130 receives data signal through the second electrode 132 and provides the data signal to the pixel electrode 140 in response to a gate driving signal applied to the first electrode 131.

The gate driver 110 connected to first ends of the gate lines G1~Gn sequentially applies the gate driving signal to the gate lines G1~Gn. The data driver 120 connected to the data lines D1~Dm applies the data signal to the data lines D1~Dm.

The discharger 150 is connected to second ends of the gate lines G1~Gn. As shown in FIG. 15, the discharger 150 discharges a second gate driving signal applied to a present gate line Gi in response to a first gate driving signal applied to a next gate line Gi+1, so that the second gate driving signal has the second power voltage Voff. The "i" is a natural number larger than "1" and smaller than "n".

The discharger 150 includes a discharging transistor 155 having a first electrode 155*a* connected to the present gate line Gi, a second electrode 155*b* connected to a terminal for the second power voltage Voff and a third electrode 155*c* connected to the next gate line Gi+1.

That is, when a voltage level of the first gate driving signal is greater than a threshold voltage of the discharging transistor 155, the discharging transistor 155 discharges the second gate driving signal into the second power voltage Voff.

As shown in FIGS. 16 and 17, when the voltage level of the first gate driving signal rises more than the threshold voltage of the discharging transistor 155, the discharging transistor 155 discharges the second gate driving signal into the second power voltage Voff. Thus, the discharging transistor 155 sufficiently discharges the second gate driving signal before the first gate driving signal is pulled up, so that the discharging transistor 155 may prevent the second gate driving signal from being delayed.

Figure 18:
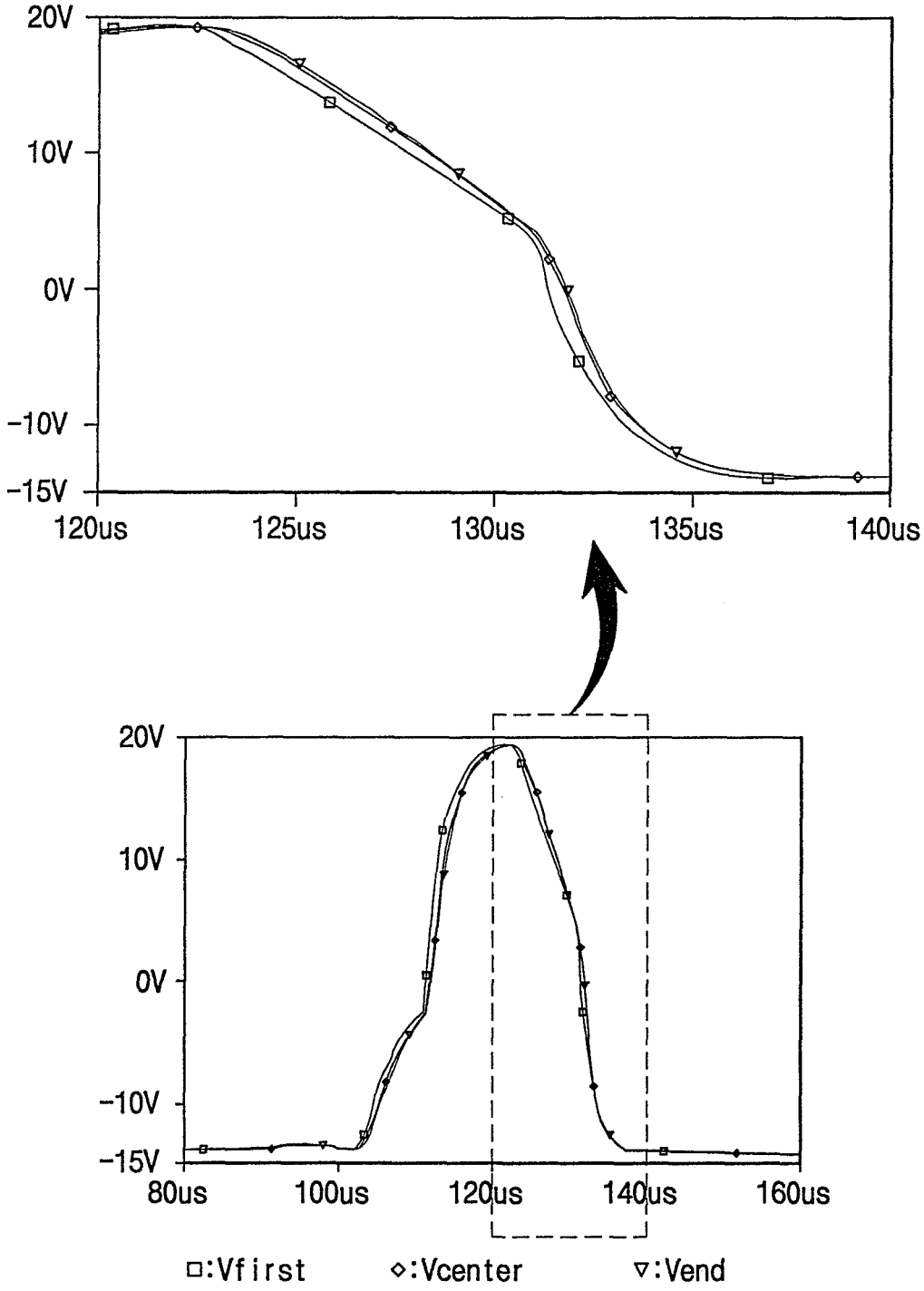
FIG. 18 is a waveform of a conventional gate driving signal.
Figure 19:
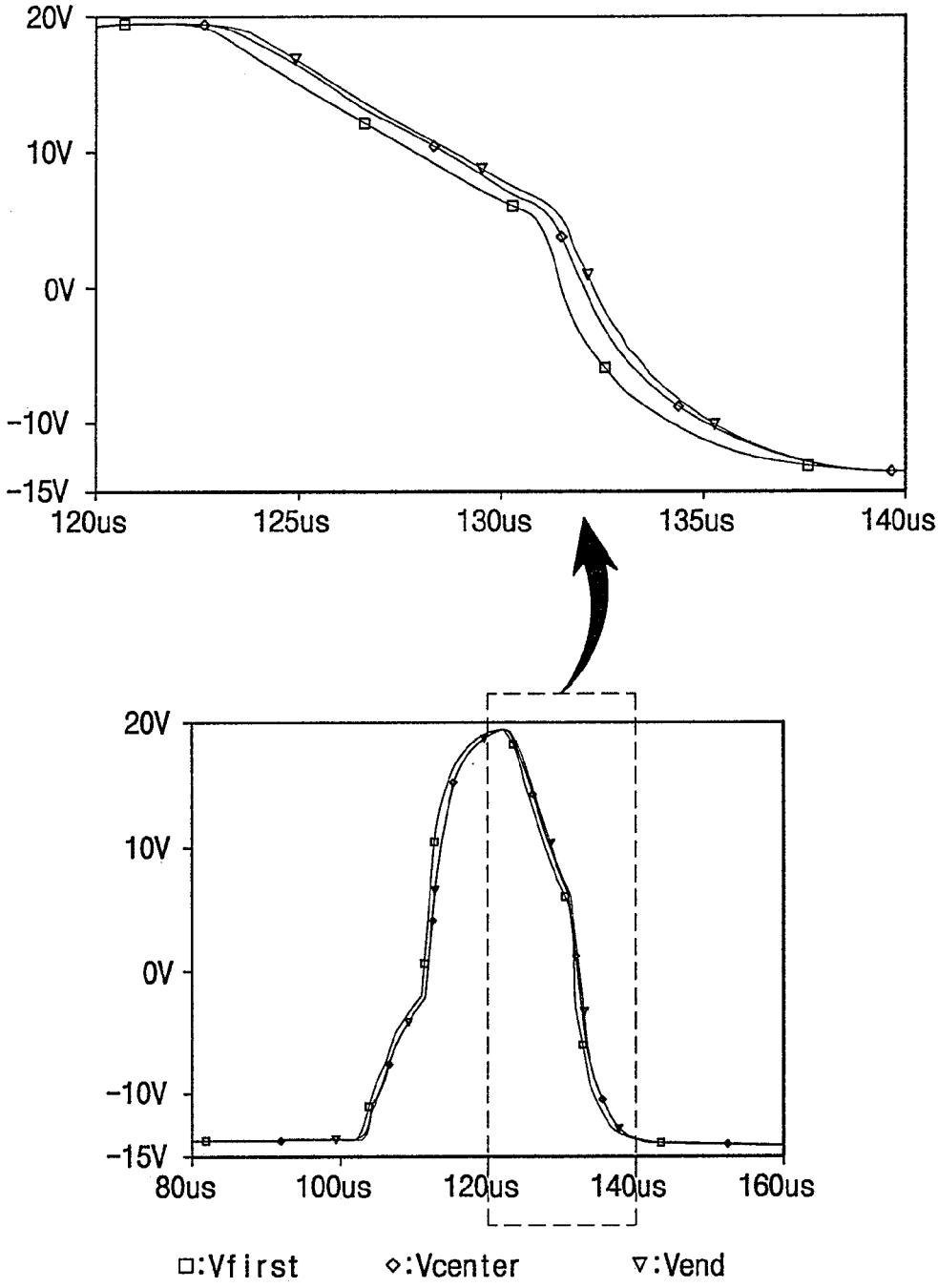
FIG. 19 is a waveform of the gate driving signal according to an embodiment of the present invention shown in FIG. 14.

FIG. 18 is a waveform of a conventional gate driving signal and FIG. 19 is a waveform of the gate driving signal according to an embodiment of the present invention shown in FIG. 14. In FIGS. 18 and 19, a first gate driving signal Vfirst applied to a first switching device among plural switching devices connected to the gate line G1 of the gate lines G1~Gn, a second gate driving signal Vcenter applied to a center switching device among plural switching devices connected to the gate line G1 of the gate lines G1~Gn and a third gate driving signal Vend applied to a last switching device among plural switching devices connected to the gate line G1 of the gate lines G1~Gn are described.

Referring to FIG. 18, the first, second and third gate driving signals Vfirst, Vcenter and Vend are completely discharged at about 140 μs and each reach the second power voltage Voff at different times, respectively.

Referring to FIG. 19, the first, second and third gate driving signals Vfirst, Vcenter and Vend are completely discharged at about 136 μs. Thus, compared with the delay time of the conventional first, second and third gate driving signals Vfirst, Vcenter and Vend shown in FIG. 18, the delay time of the first, second and third gate driving signals Vfirst, Vcenter and Vend according to an embodiment of the present invention may be reduced about 4 μs. Also, since the first, second and third gate driving signals Vfirst, Vcenter and Vend reach the second power voltage Voff at the same time, the delaying characteristics of the first, second and third gate driving signals Vfirst, Vcenter and Vend are thereby improved.

Figure 20:
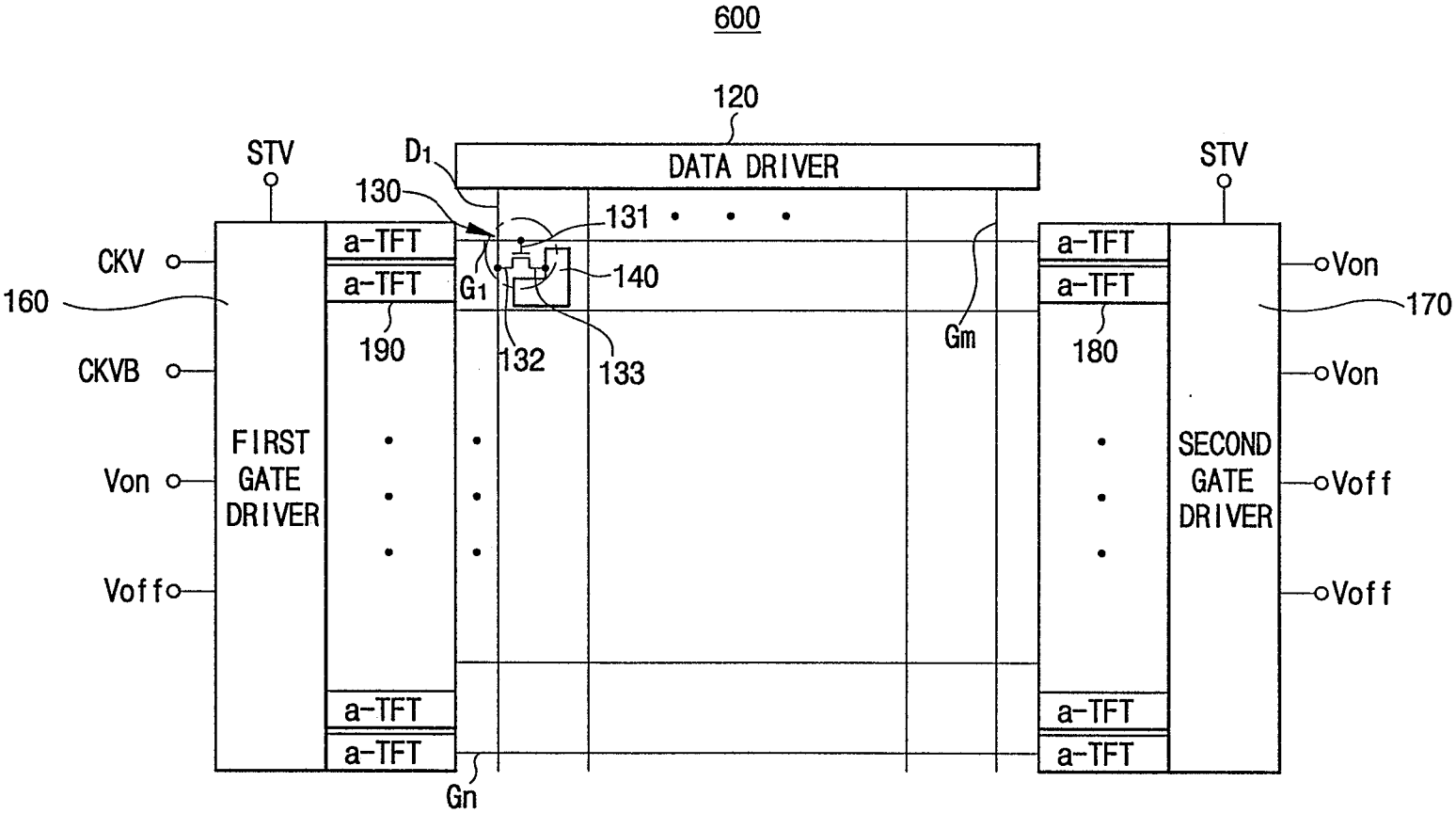
FIGS. 20 and 21 are schematic views showing LCD apparatuses according to other embodiments of the present invention.
Figure 21:
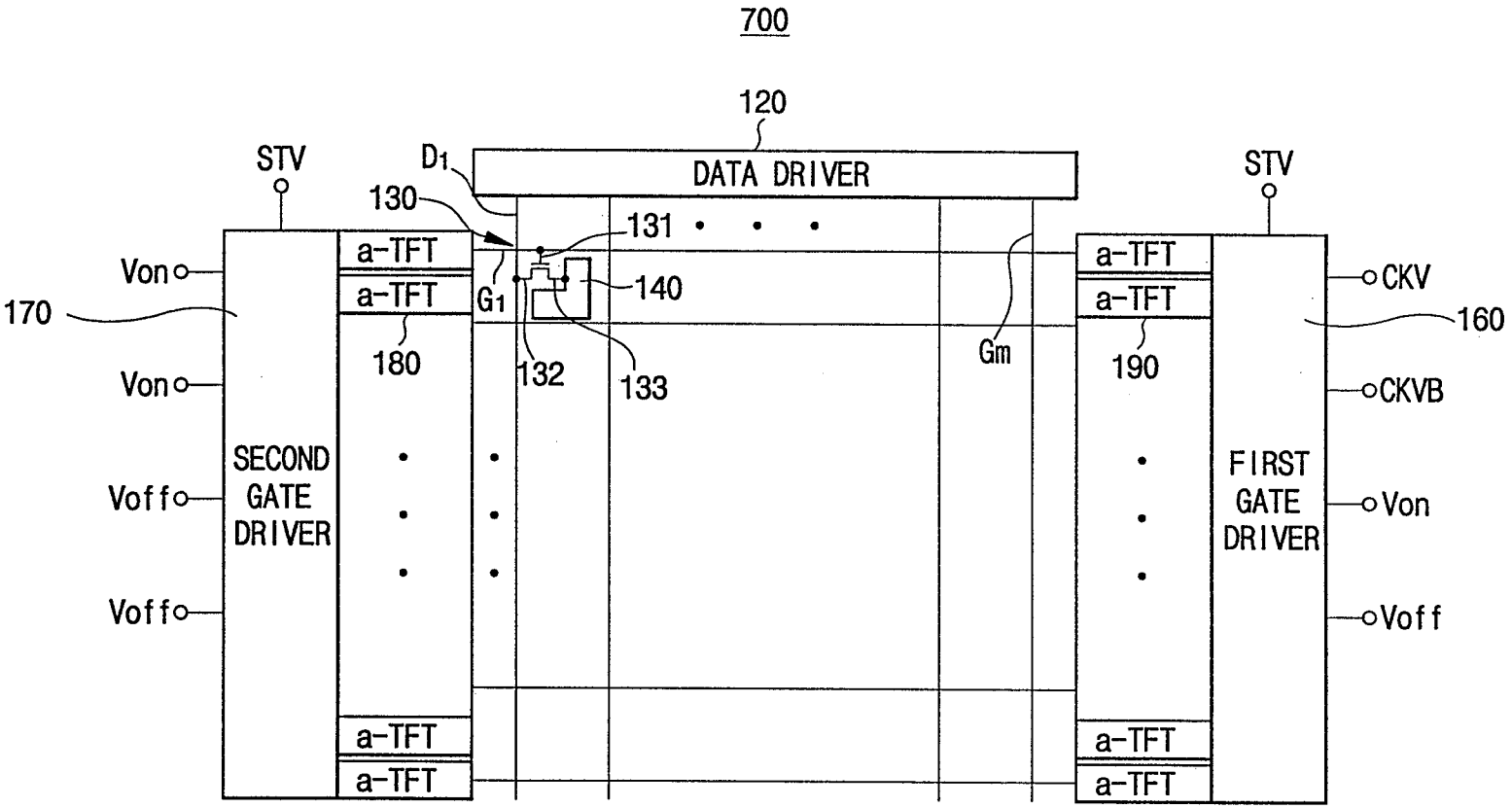

FIGS. 20 and 21 are schematic views showing LCD apparatuses according to other embodiments of the present invention.

Referring to FIG. 20, an LCD apparatus 600 includes a first gate driver 160, a second gate driver 170, a data driver 120, a first discharger 180 and a second discharger 190.

The LCD panel 600 includes a plurality of gate lines G1~Gn extended in a first direction, a plurality of data lines D1~Dm extended in a second direction perpendicular to the first direction, a TFT 130 having a first electrode 131 connected to the gate lines G1~Gn and a second electrode 132 connected to the data lines D1~Dm and a pixel electrode 140 connected to a third electrode 133 of the TFT 130. The TFT 130 receives a data signal through the second electrode 132 and provides the data signal to the pixel electrode 140 in response to a gate driving signal applied to the first electrode 131 thereof.

The first gate driver 160 connected to first ends of the gate lines G1~Gn sequentially applies the gate driving signal to the gate lines G1~Gn. The data driver 120 connected to the data lines D1~Dm applies the data signal to the data lines D1~Dm when the gate driving signal is applied to the gate lines G1~Gn.

The second gate driver 170 connected to second ends of the gate lines G1~Gn sequentially applies the gate driving signal to the gate lines G1~Gn when the first gate driver 160 is in an abnormal operation state. Thus, although the first gate driver 160 is operated in the abnormal state, the LCD apparatus 600 may be operated in a normal state while the second gate driver 170 is in a normal operation state.

The first and second gate drivers 160 and 170 respectively have a shift register having plural stages connected one after another to each other. Respective stages of the shift register have a same configuration.

As shown in FIG. 20, the first gate driver 160 includes five input terminals for receiving signals, such as a first vertical start signal STV, a first clock signal CKV, a second clock signal CKVB, a first power voltage Von and a second power voltage Voff, from an external device.

The second gate driver 170 also includes five input terminals. The second gate driver 170 receives the first vertical start signal STV, the first power voltage Von and the second power voltage Voff while the first gate driver 160 is operated in the normal state. That is, the second gate driver 170 receives the first power voltage Von instead of the first and second clock signals CKV and CKVB and the second power voltage Voff instead of the input terminal for the first power voltage Von. Thus, the second gate driver 170 maintains a bias state while the first gate driver 160 is operated in the normal state.

However, when the first gate driver 160 is operated in the abnormal state, the second gate driver 170 receives the first clock signal CKV, the second clock signal CKVB and the first power voltage Von, so that the second gate driver 170 may output the gate driving signal to the gate lines G1~Gn.

To prevent the gate driving signal from being delayed when the first gate driver 160 is operated, the first discharger 180 is connected to the second ends of the gate lines G1~Gn. The second discharger 190 is connected to the first ends of the gate lines G1~Gn so as to prevent the gate driving signal from being delayed when the second gate driver 170 is operated.

The first discharger 180 includes a first discharging transistor having a first electrode connected to a first end of a present gate line, a second electrode connected to the terminal for the second power voltage Voff and a third electrode connected to a first end of a next gate line. Accordingly, the first discharging transistor is operated in response to a first gate driving signal applied from the first gate driver 160 to the next gate line to discharge the second gate driving signal applied to the present gate line into the second power voltage Voff.

The second discharger 190 includes a second discharging transistor having a first electrode connected to a second end of the present gate line, a second electrode connected to the terminal for the second power voltage Voff and a third electrode connected to a second end of the next gate line. Accordingly, the second discharging transistor is operated in response to a first gate driving signal applied from the second gate driver 170 to the next gate line to discharge the second gate driving signal applied to the present gate line into the second power voltage Voff.

In FIG. 20, the first and second gate drivers 160 and 170 are disposed adjacent to the first and second ends of the gate lines G1~Gn, respectively. However, the first and second gate drivers 160 and 170 may be disposed adjacent to second and first ends of the gate lines G1~Gn, respectively.

As shown in FIG. 21, in LCD apparatus 700, a second gate driver 170 is connected to the first ends of the gate lines G1~Gn and the first gate driver 160 is connected to the second ends of the gate lines G1~Gn. The second gate driver 170 is operated while the first gate driver 160 is operated in an abnormal state.

Figure 22:
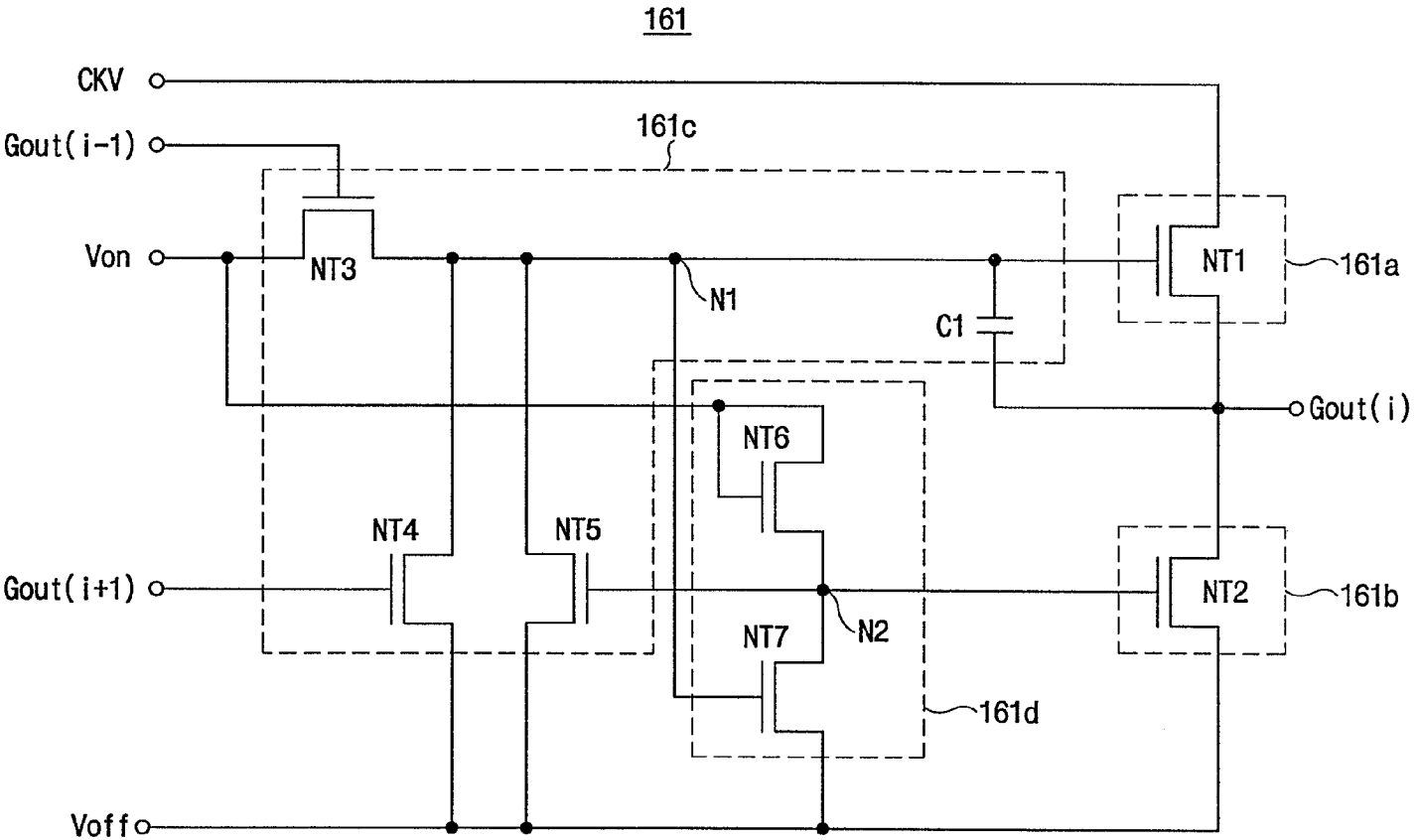
FIG. 22 is a circuit diagram showing the first gate driver shown in FIG. 20.
Figure 23:
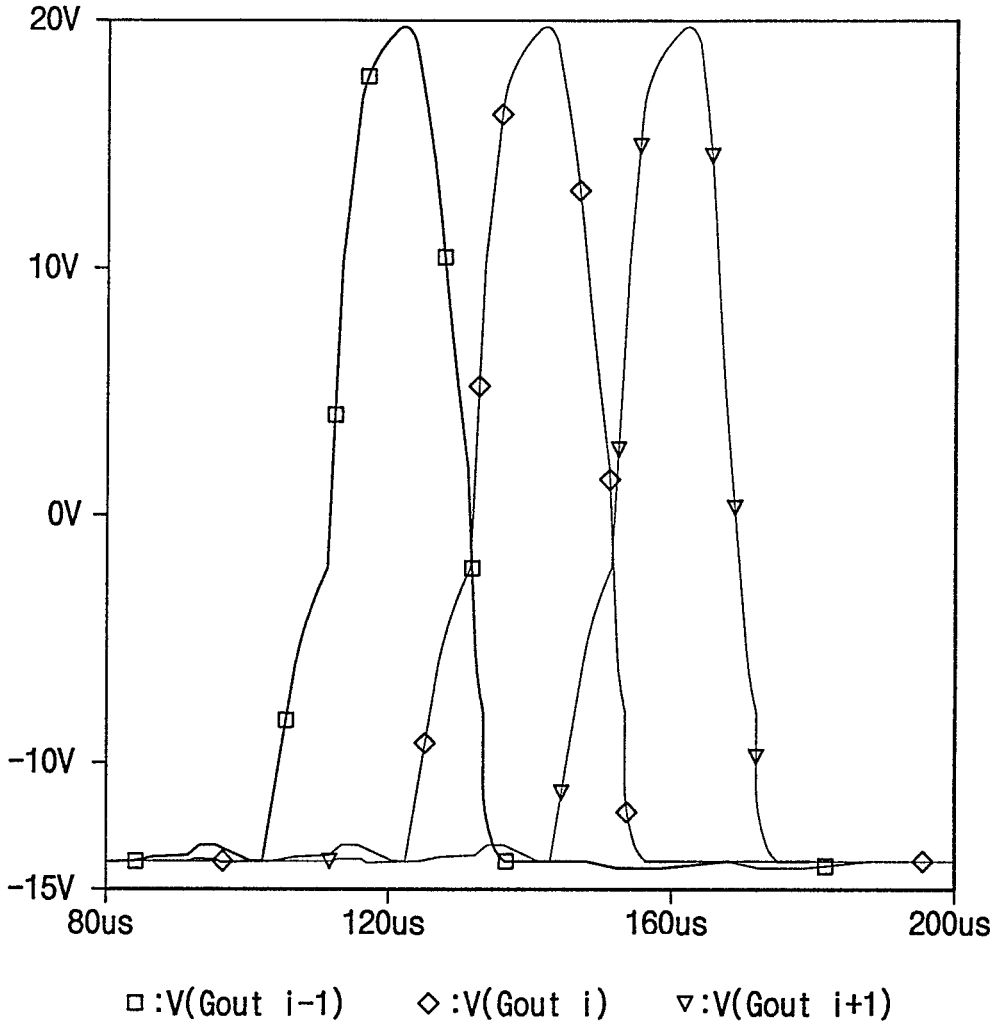
FIG. 23 is a waveform of output from the first gate driver shown in FIG. 22.

FIG. 22 is a circuit diagram showing the first gate driver shown in FIG. 20 and FIG. 23 is a waveform of output from the first gate driver shown in FIG. 22. The first gate driver 160 has a shift register having plural stages connected one after another to each other. Respective stages of the shift register have a same configuration.

Referring to FIG. 22, each stage 161 of the shift register includes a pull-up section 161*a*, a pull-down section 161*b*, a pull-up driving section 161*c* and a pull-down driving section 161*d*.

The pull-up section 161*a* includes a first NMOS transistor NT1 of which a drain is connected to a clock signal input terminal CKV, a gate is connected to a first node N1 and a source is connected to an output terminal Gout(i) of the present stage.

The pull-down section 161*b* includes a second NMOS transistor NT2 of which a drain is connected to an output terminal Gout(i), a gate is connected to a second node N2 and a source is connected to a second power voltage Voff.

The pull-up driving section 161*c* includes a capacitor C1 and third to fifth NMOS transistors NT3 to NT5. The capacitor C1 is connected between the first node N1 and the output terminal Gout(i). The third NMOS transistor NT3 has a drain connected to the first power voltage Von, a gate connected to the terminal Gout(i−1) and a source connected to the first node N1. The fourth NMOS transistor NT4 has a drain connected to the first node N1, a gate connected to an output terminal Gout(i+1) of the next stage and a source connected to the second power voltage Voff. The fifth NMOS transistor NT5 has a drain connected to the first node N1, a gate connected to the second node N2 and a source connected to the second power voltage Voff.

The pull-down driving section 161*d* includes sixth and seventh NMOS transistors NT6 and NT7. The sixth NMOS transistor NT6 has drain and gate commonly connected to the first power voltage Von and a source connected to the second node N2. The seventh NMOS transistor NT7 has a drain connected to the second node N2, a gate connected to the first node N1 and a source connected to the second power voltage Voff. The sixth NMOS transistor NT6 has a size ratio of 16:1 to the seventh NMOS transistor NT7.

When first and second clock signals CKV and CKVB and first vertical start signal STV are applied, each stage sequentially outputs the gate driving signal. That is, each stage outputs the first clock signal CKV of a high level period as the gate driving signal through the output terminal Gout(i) in response to an output signal of a previous stage.

As the high level period of the first clock signal CKV is generated at the output terminal Gout(i), the output voltage is bootstrapped at the capacitor C1 and thereby the gate voltage of the first NMOS transistor NT1 rises over the turn-on voltage VDD. Accordingly, the first NMOS transistor NT1 maintains a full turn-on state. At this time, the third NMOS transistor NT3 has a size ratio of 2:1 to the fifth NMOS transistor NT5. Thus, although the fifth NMOS transistor NT5 is turned on in response to the first vertical start signal STV, the first NMOS transistor NT1 is transited to the turn-on state.

In the pull-down driving section 161*d*, since the seventh NMOS transistor NT7 is turned off and a potential of the second node N2 rises to the first power voltage Von, the second NMOS transistor NT2 is turned on. Thus, the gate driving signal outputted from the output terminal Gout(i) maintains the second power voltage Voff. At this time, the potential of the second node N2 is dropped to the second power voltage Voff because the seventh NMOS transistor NT7 is turned on in response to the gate driving signal outputted from the output terminal Gout(i−1) of the previous stages.

Although the sixth NMOS transistor NT6 is turned on, the second node N2 maintains the second power voltage Voff since a size of the seventh NMOS transistor NT7 is larger 16 times than the sixth NMOS transistor NT6. Therefore, the second NMOS transistor NT2 is transited from the turn-on state to the turn-off state.

When a potential of the gate driving signal outputted from the output terminal Gout(i) of the present stage is dropped to the second power voltage Voff, the seventh NMOS transistor NT7 is turned off. The potential of the second node N2 rises from the second power voltage Voff to the first power voltage Von because the second node N2 receives the first power voltage Von through the sixth NMOS transistor NT6. When the fifth NMOS transistor NT5 is turned on while rising the potential of the second node N2, the charged voltage into the capacitor C1 is discharged so as to turn off the first NMOS transistor NT1.

Responsive to the voltage level of the gate driving signal outputted from the output terminal Gout(i+1) of the next stage having the turn-on voltage, the fourth NMOS transistor NT4 is turned on. At this time, the potential of the first node N1 is rapidly dropped to the second power voltage Voff while only the fifth NMOS transistor NT5 is turned on since a size of the fourth NMOS transistor NT4 is larger 2 times than the fifth NMOS transistor NT5. Therefore, the first NMOS transistor NT1 is turned off and the second NMOS transistor NT2 is turned on, so that the gate driving signal from the output terminal Gout(i) of the present stage is dropped from the first power voltage Von to the second power voltage Voff.

Although the fourth NMOS transistor NT4 is turned off in response to the gate driving signal outputted from the output terminal Gout(i+1) of the next stage dropping to the second power voltage Voff, the second node N2 maintains the first power voltage Von through the sixth NMOS transistor NT6 and the first node N1 maintains the second power voltage Voff through the fifth NMOS transistor NT5. Therefore, the potential of the second node N2 may maintain the first power voltage Von and prevent the second NMOS transistor NT2 from being turned off.

Figure 24:
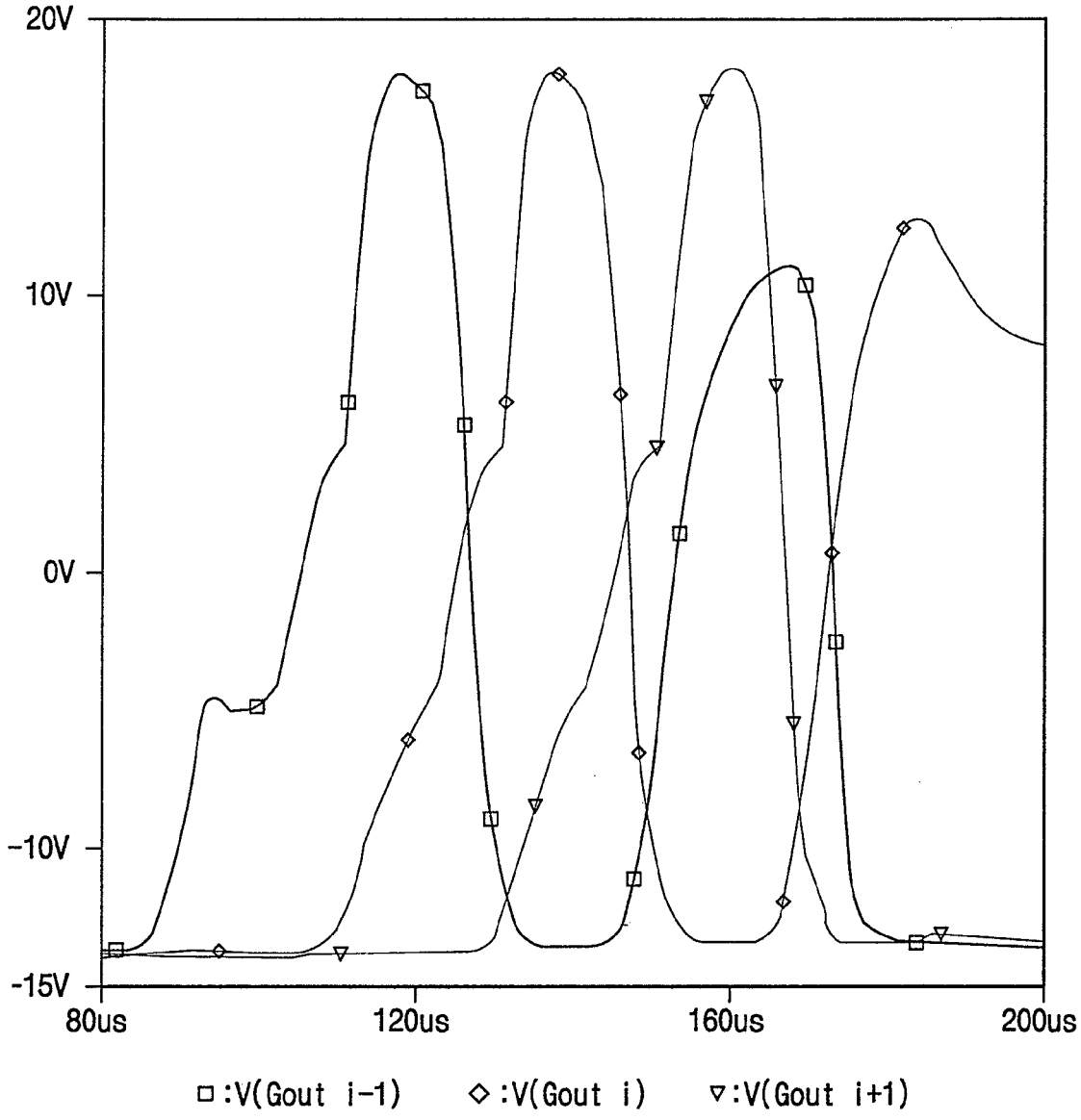
FIG. 24 is a waveform showing output signals of the first gate driver in the case of applying the first power voltage to the first power voltage input terminal of the second gate driver shown in FIG. 20.
Figure 25:
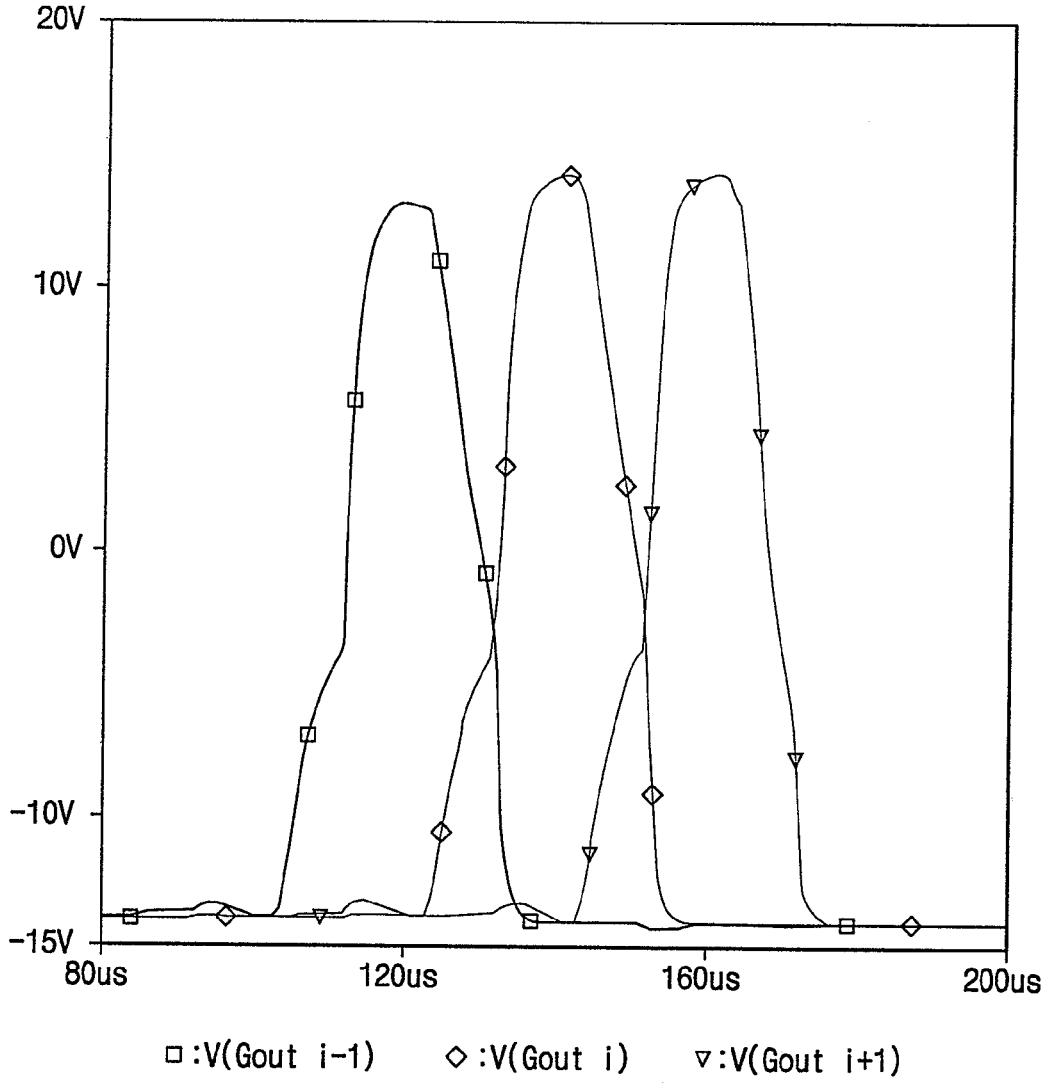
FIG. 25 is a waveform showing output signals of the first gate driver in the case of applying the second power voltage to the first and second clock input terminals of the second gate driver shown in FIG. 20.

FIG. 24 is a waveform showing output signals of the first gate driver in the case of applying the first power voltage to the first power voltage input terminal of the second gate driver shown in FIG. 20. FIG. 25 is a waveform showing output signals of the first gate driver in the case of applying the second power voltage to the first and second clock input terminals of the second gate driver shown in FIG. 20.

Referring to FIG. 24, in the case of applying the first power voltage Von to the input terminal for the first power voltage Von of the second gate driver 170, the output waveforms from respective stages of the first gate driver 160 are outputted in abnormal waveforms. As a result, the display characteristics of the LCD apparatus are deteriorated.

As shown in FIG. 25, in the case of applying the second power voltage Voff to the input terminals for the first and second clock signals CKV and CKVB of the second gate driver 170, the voltage levels of the output waveforms from respective stages of the first gate driver 160 are dropped. As a result, the power consumption of the first gate driver 160 increases.

Thus, the input terminals for the first and second clock signals CKV and CKVB of the second gate driver 170 receive the first power voltage Von and the input terminal for the first power voltage Von of the second gate driver 170 receives the second power voltage Voff while the first gate driver 160 is operated in the normal state.

According to the LCD apparatus, the clock generator generates the first and second clock signals respectively having a first period that determines the voltage level of the gate driving signal and a second period that charges or discharges the first and second clock signals and applies the first and second clock signals to the gate driver so as to control the pulse width of the gate driving signal. Therefore, the gate driver may normally drive the gate lines corresponding to the 1H frame, thereby improving the display characteristics of the LCD apparatus.

Also, since the gate lines have the discharging transistor connected to first ends thereof, the present stage may be discharged before operating the next stage, thereby preventing the gate driving signal from being delayed.

Further, the gate lines include have the first gate driver connected to first ends thereof and the second gate driver connected to second ends thereof. The second gate driver normally operates the gate lines while the first gate driver is operated in abnormal state. Thus, although the first gate driver is abnormally operated, the LCD apparatus may be operated in normal state due to the second gate driver.

Although the exemplary embodiments of the present invention have been described, it is to be understood that the present invention should not be limited to these exemplary embodiments but various changes and modifications can be made by one ordinary skilled in the art within the spirit and scope of the present invention as hereinafter claimed.

What is claimed is:

1. An LCD apparatus comprising:

an LCD panel having a plurality of gate lines extended in a first direction, a plurality of data lines extended in a second direction, a switching device having a first electrode connected to the gate lines and a second electrode connected to the data lines and a pixel electrode connected to a third electrode of the switching device;

a gate driver connected to the gate lines for sequentially applying a gate driving signal to the gate lines;

a data driver connected to the data lines for applying a data driving signal to the data lines; and a discharger for discharging a second gate driving signal applied to a present gate line in response to a first gate driving signal applied to a next gate line, wherein the gate driver receives first and second clock signals comprising a first time period and a third time period for determining a level of the gate driving signal and an initial time period and a second time period for charging or discharging the first and second clock signals, respectively, wherein voltage level of the first clock signal gradually increases from a first power voltage level to a first intermediate voltage level between the first power voltage level and a second power voltage level during the initial time period and remains constant at the second power voltage level during the first time period sequent to the initial time period, upon gradually increasing from the first power voltage level to the first intermediate voltage level a first immediate step transition is made to the second power voltage level, voltage level of the first clock signal gradually decreases from the second power voltage level to a second intermediate voltage level between the first power voltage level and the second power voltage level during the second time period sequent to the first time period and remains constant at the first power voltage level during the third time period sequent to the second time period, upon gradually decreasing from the second power voltage level to the second intermediate voltage level a second immediate step transition is made to the first power voltage level voltage level of the second clock signal gradually decreases from the second power voltage level to the second intermediate voltage level during the initial time period and remains constant at the first power voltage level during the first time period sequent to the initial time period, upon gradually decreasing from the second power voltage level to the second intermediate voltage level a third immediate step transition is made to the first power voltage level, voltage level of the second clock signal gradually increases from the first power voltage level to the first intermediate voltage level during the second time period sequent to the first time period and remains constant at the second power voltage level during the third time period sequent to the second time period, upon gradually increasing from the first power voltage level to the first intermediate voltage level a fourth immediate step transition is made to the second power voltage level, and the initial time period is sequent to the third time period.

2. The LCD apparatus of claim 1, wherein the discharger comprises a transistor of which a first electrode is connected to the present gate line and a second electrode is connected to a discharge voltage input terminal for discharging the second gate driving signal in response to the first gate driving signal.

3. The LCD apparatus of claim 1, wherein the second clock signal has a phase opposite to that of the first clock signal.

4. The LCD apparatus of claim 3, wherein the first clock signal comprises a first voltage during the first time period and a first polarity during the second time period, and the second clock signal comprises a second voltage having a phase opposite to that of the first voltage during the first time period and a second polarity having a phase opposite to that of the first polarity during the second time period, the first and second clock signals having a slope during the second time period, respectively.

5. An LCD apparatus comprising:

a LCD panel having a plurality of gate lines extended in a first direction, a plurality of data lines extended in a second direction perpendicular to the first direction, a switching device having a first electrode connected to the gate lines and a second electrode connected to the data lines and a pixel electrode connected to a third electrode of the switching device;

a first gate driver connected to first ends of the gate lines for sequentially applying a gate driving signal to the gate lines;

a second gate driver connected to second ends of the gate lines for sequentially applying the gate driving signal to the gate lines when the first gate driver is in an abnormal state;

a data driver connected to the data lines for applying a data driving signal to the data lines; and a first discharger for discharging a second gate driving signal applied to a present gate line in response to a first gate driving signal applied to a next gate line when the first gate driver is operated; and a second discharger for discharging the second gate driving signal in response to the second gate driving signal when the second gate driver is operated, wherein the gate driver receives first and second clock signals comprising a first time period for determining a level of the gate driving signal and a second time period for charging or discharging the first and second clock signals, respectively, wherein voltage level of the first clock signal gradually increases from a first power voltage level to a first intermediate voltage level between the first power voltage level and a second power voltage level during the initial time period and remains constant at the second power voltage level during the first time period sequent to the initial time period, upon gradually increasing from the first power voltage level to the first intermediate voltage level a first immediate step transition is made to the second power voltage level, voltage level of the first clock signal gradually decreases from the second power voltage level to a second intermediate voltage level between the first power voltage level and the second power voltage level during the second time period sequent to the first time period and remains constant at the first power voltage level during the third time period sequent to the second time period, upon gradually decreasing from the second power voltage level to the second intermediate voltage level a second immediate step transition is made to the first power voltage level, voltage level of the second clock signal gradually decreases from the second power voltage level to the second intermediate voltage level during the initial time period and remains constant at the first power voltage level during the first time period sequent to the initial time period, upon gradually decreasing from the second power voltage level to the second intermediate voltage level a third immediate step transition is made to the first power voltage level, voltage level of the second clock signal gradually increases from the first power voltage level to the first intermediate voltage level during the second time period sequent to the first time period and remains constant at the second power voltage level during the third time period sequent to the second time period, upon gradually increasing from the first power voltage level to the first intermediate voltage level a fourth immediate step transition is made to the second power voltage level, and the initial time period is sequent to the third time period.

6. The LCD apparatus of claim 5, further comprising an external connection terminal connected to the first gate driver, wherein the external connection terminal comprises:

a first input terminal for receiving a start signal;

a second input terminal for receiving a first clock signal;

a third input terminal for receiving a second clock signal having a phase opposite to that of the first clock signal;

a fourth input terminal for receiving a first power voltage; and a fifth input terminal for receiving a second power voltage.

7. The LCD apparatus of claim 5, further comprising an external connection terminal connected to the second gate driver, wherein the external connection terminal comprises:

a first input terminal for receiving a start signal;

a second input terminal for selectively receiving a first clock signal and a first power voltage;

a third input terminal for selectively receiving a second clock signal having a phase opposite to that of the first clock signal and a second power voltage;

a fourth input terminal for selectively receiving the first power voltage and the second power voltage; and a fifth input terminal for receiving the second power voltage.

8. The LCD apparatus of claim 5, wherein the first discharger comprises a first transistor of which a first electrode is connected to the present gate line and a second electrode is connected to a discharge voltage input terminal for discharging the second gate driving signal in response to the first gate driving signal.

9. The LCD apparatus of claim 5, wherein the second discharger comprises a second transistor of which a first electrode is connected to the present gate line and a second electrode is connected to a discharge voltage input terminal for discharging the second gate driving signal in response to the first gate driving signal.

* * * * *